US009272321B2

(12) United States Patent
Breen et al.

(10) Patent No.: US 9,272,321 B2
(45) Date of Patent: Mar. 1, 2016

(54) GUIDED KEEPER AND METHOD FOR METAL FORMING DIES

(75) Inventors: Scott M. Breen, Marne, MI (US); Joel T. Pyper, Grand Rapids, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 1296 days.

(21) Appl. No.: 13/159,485

(22) Filed: Jun. 14, 2011

(65) Prior Publication Data

US 2011/0302988 A1 Dec. 15, 2011

Related U.S. Application Data

(60) Provisional application No. 61/397,606, filed on Jun. 14, 2010, provisional application No. 61/397,586, filed on Jun. 14, 2010.

(51) Int. Cl.

| | |
|---|---|
| ***B21D 37/12*** | (2006.01) |
| ***B21D 37/20*** | (2006.01) |
| *B21D 45/06* | (2006.01) |

(52) U.S. Cl.

CPC ..... *B21D 37/12* (2013.01); *B21D 37/20* (2013.01); *B21D 45/06* (2013.01); *Y10T 29/49963* (2015.01)

(58) Field of Classification Search

CPC ..... B21D 37/02; B21D 37/14; B21D 37/20; B21D 37/04; B21D 37/06; B21D 37/10; B21D 37/12; B30B 15/02; B30B 15/026; B30B 15/04; B30B 15/041; B30B 15/047; B30B 15/06

See application file for complete search history.

(56) References Cited

U.S. PATENT DOCUMENTS

| | | | |
|---|---|---|---|
| 2,346,297 | A | 4/1944 | Garbe |
| 2,487,233 | A | 11/1949 | Gerke |
| 2,627,313 | A | 2/1953 | Marsilius |
| 2,629,615 | A | 2/1953 | Marsilius |
| 2,663,180 | A | 12/1953 | Benedict |
| 2,979,004 | A | 4/1961 | Kenville et al. |
| 3,386,781 | A | 6/1968 | Blazek et al. |
| 3,474,656 | A | 10/1969 | Kraft |
| 3,514,166 | A | 3/1970 | Coley |
| 3,568,555 | A | 3/1971 | Stroh |
| 3,664,258 | A | 5/1972 | Vecchi |
| 3,730,039 | A | 5/1973 | Fedrigo |
| 3,897,118 | A | 7/1975 | Wolfthal |
| 4,003,283 | A | 1/1977 | Janiszewski |
| 4,080,819 | A | 3/1978 | Hook et al. |
| 4,135,770 | A | 1/1979 | Doherty et al. |
| 4,199,313 | A | 4/1980 | Bohnenberger |
| 4,282,736 | A | 8/1981 | Mashburn |

(Continued)

*Primary Examiner* — Shelley Self
*Assistant Examiner* — Pradeep C Battula
(74) *Attorney, Agent, or Firm* — Price Heneveld LLP

(57) ABSTRACT

A guided keeper assembly includes a base, at least one marginal fastener aperture to detachably mount the base to an associated die shoe, and a central guide aperture. A guide pin is closely received in the central aperture of the base. A first end of the guide pin has an enlarged head to positively limit travel between the die shoe and die pad, and an opposite second end with a generally flat terminal shoulder configured for close reception in a blind hole in the die pad. The shoulder has a fastener aperture at a location spaced radially offset from the central axis of the guide pin. A fastener extends through the fastener aperture in the die pad and engages in the fastener aperture in the second end of the guide pin to securely, yet detachably, connect the second end portion of the guide pin with the die pad.

34 Claims, 12 Drawing Sheets

(56) References Cited

U.S. PATENT DOCUMENTS

| | | | |
|---|---|---|---|
| 4,326,402 | A | 4/1982 | Wallis |
| 4,483,173 | A | 11/1984 | Duhamel |
| 4,696,180 | A | 9/1987 | Zandel |
| 4,732,033 | A | 3/1988 | Smedberg et al. |
| 4,742,746 | A | 5/1988 | Olsson |
| 4,765,227 | A | 8/1988 | Balazs et al. |
| 4,796,460 | A | 1/1989 | Smedberg et al. |
| 4,836,071 | A | 6/1989 | Ersoy |
| 5,113,736 | A | 5/1992 | Meyerle |
| 5,243,743 | A | 9/1993 | Peterson |
| 5,245,904 | A | 9/1993 | Meyerle |
| 5,722,280 | A | 3/1998 | Bodnar |
| 5,775,212 | A | 7/1998 | Takao |
| 5,788,903 | A | 8/1998 | Allgaier |
| 5,974,852 | A | 11/1999 | Nieschulz |
| 6,408,728 | B1 | 6/2002 | Tsuji et al. |
| 6,848,290 | B2 | 2/2005 | Pyper et al. |
| 6,895,797 | B2 | 5/2005 | Lowry et al. |
| 6,925,922 | B2 | 8/2005 | Manabe et al. |
| 6,986,273 | B2 | 1/2006 | Rager |
| 7,000,446 | B2 | 2/2006 | Nieschulz et al. |
| 7,004,007 | B2 | 2/2006 | Kruger et al. |
| 7,114,365 | B2 | 10/2006 | Rooney, Jr. et al. |
| 7,152,451 | B1 | 12/2006 | Cotter |
| 7,730,757 | B2 | 6/2010 | Pyper et al. |
| 7,861,569 | B2 | 1/2011 | Cotter et al. |
| 7,950,262 | B2 | 5/2011 | Pyper et al. |
| 2002/0124706 | A1 | 9/2002 | Mochizuki |
| 2007/0037434 | A1 | 2/2007 | Fedder et al. |
| 2007/0079489 | A1 * | 4/2007 | Cirino ..... 29/33 K |
| 2008/0053186 | A1 | 3/2008 | Pyper et al. |
| 2009/0078022 | A1 | 3/2009 | Miceli et al. |
| 2009/0193865 | A1 | 8/2009 | Pyper et al. |
| 2009/0205397 | A1 | 8/2009 | Yates |

* cited by examiner

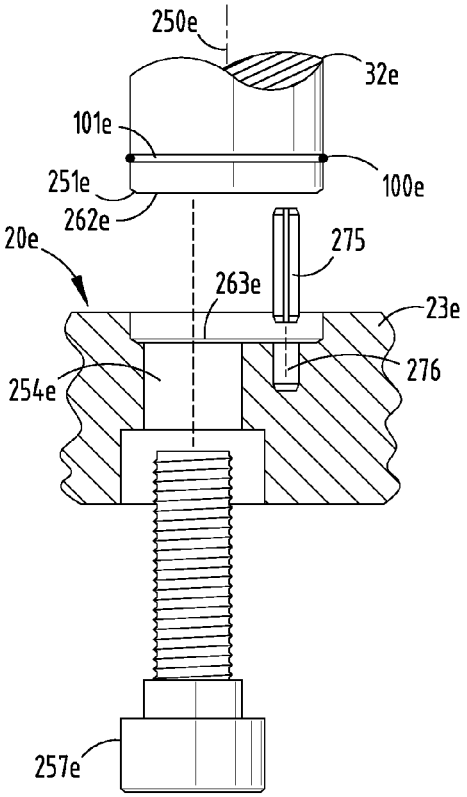
FIG. 58
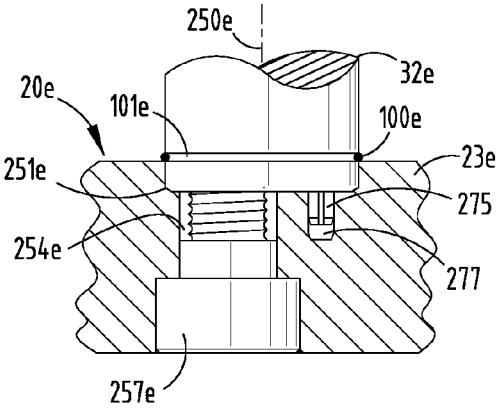
FIG. 59
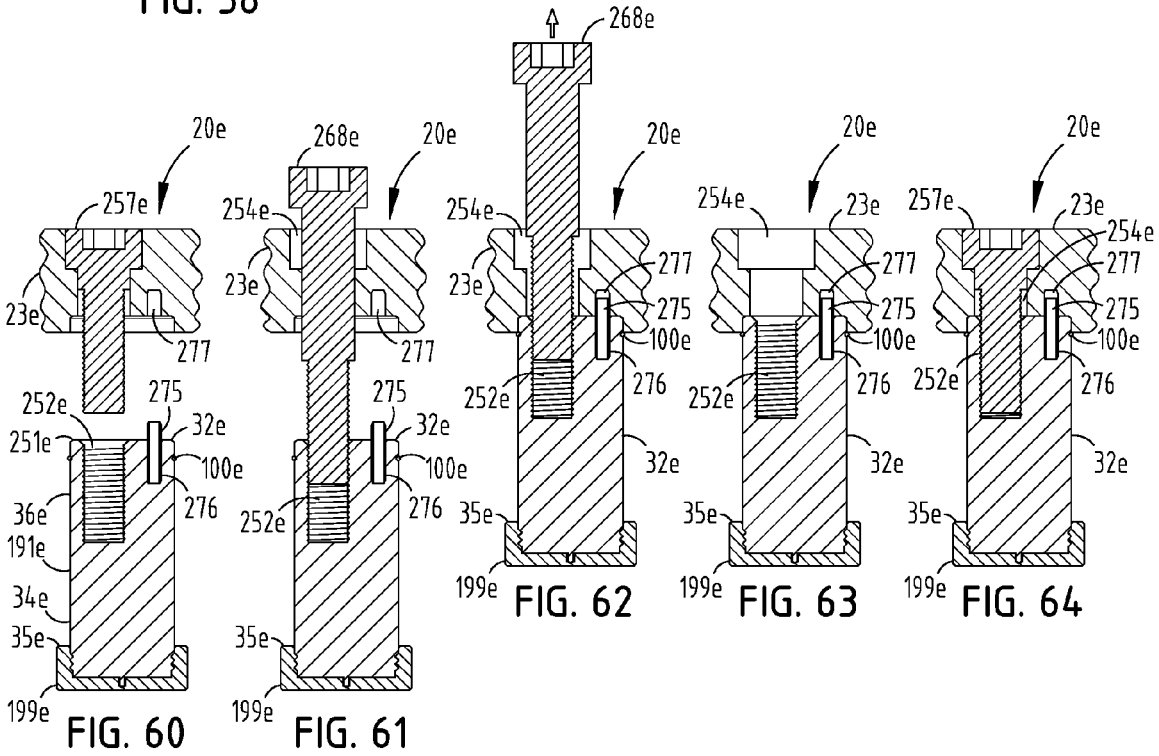

GUIDED KEEPER AND METHOD FOR METAL FORMING DIES

CROSS-REFERENCE TO RELATED APPLICATIONS

This application claims priority under 35 U.S.C. §119(e) to U.S. Provisional Patent Application No. 61/397,606, filed on Jun. 14, 2010, entitled "IMPROVED GUIDE PIN CONNECTION WITH OFFSET TAPS," and U.S. Provisional Patent Application No. 61/397,586, filed on Jun. 14, 2010, entitled "IMPROVED GUIDE PIN CONSTRUCTION WITH ROLL PIN," the disclosures of which are hereby incorporated herein by reference in their entirety.

BACKGROUND OF THE INVENTION

The present invention relates to metal forming dies and the like, and in particular to an improved guide pin connection and associated method having a flat shouldered guide pin with offset fastener.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

As outlined in U.S. Pat. No. 7,730,757 and U.S. Pat. Pub. 2009/0193865, which are hereby wholly incorporated herein by reference, heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed, and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture and repair or modify.

FIGS. 4 and 5 illustrate a prior art metal forming die that includes a die shoe 1 and a die pad 2, which are interconnected for mutual reciprocation by a plurality of spools 3. A spring mechanism 4 is mounted between die shoe 1 and die pad 2, and resiliently urges die pad 2 to a fully extended position. A metal forming die 5 is mounted on the outer surface of die pad 2. Each of the spools 3 includes an enlarged head 6 which reciprocates in an associated counter bore 7 in the bottom of die shoe 1. The heads 6 of spools 3 engage the top of the associated counter bores 7 to positively retain die pad 2 in its fully extended position. The other ends 8 of spools 3 are attached to the corners of die pad 2. While such constructions have been generally successful, they do not precisely control reciprocation between die pad 2 and die shoe 1, particularly in high speed, progressive die applications.

FIGS. 6 and 7 illustrate another prior art configuration, wherein pressed in pins 10, with locator bushings 11, have been added to the spools 3 shown in FIG. 1 to more precisely control the reciprocation between die pad 2 and die shoe 1.

FIGS. 8 and 9 illustrate yet another prior art configuration, which includes guide pins 10 and bushings 11, but substitutes footed keepers 13 and 14 for the common spools 3 to positively limit the reciprocation between die pad 2 and die shoe 1. More specifically, footed keepers 13 are mounted to die pad 2, and engage mating footed keepers 14 which are mounted on die shoe 1.

SUMMARY OF THE INVENTION

One aspect of the present invention is a method for making a metal forming die of the type having a die shoe, a die pad mounted a spaced apart distance of the die shoe for reciprocation between converged and diverged positions, and a biasing member disposed between the die shoe and the die pad for biasing the same to the diverged position. The method includes forming a base with a mounting face shaped to abut an adjacent face of the die shoe, at least one fastener aperture extending axially through a marginal portion of the base for detachably mounting the base to the die shoe, and a cylindrically shaped central aperture extending axially through a central portion of the base and having a bearing surface. The method further includes forming a guide pin with the first end portion having an enlarged head shaped to abut the base to positively limit travel between the die shoe and the die pad, and a cylindrically shaped body portion having a uniform diameter extending along the entirety of the central axis thereof, selected for close reception in the central aperture of the base and a second end portion disposed opposite the first end portion with a generally flat, terminal shoulder. The method further includes forming a fastener aperture perpendicularly through the shoulder of the guide pin and into the second end portion thereof at a location spaced radially offset from the central axis of the body portion of the guide pin, and oriented parallel therewith. The method also includes forming a blind hole in the die pad at a pre-selected location with a diameter shaped for close reception to the shoulder of the guide pin therein, and forming at least one fastener aperture in the die pad at a preselected location which opens into the blind hole. The method also includes forming at least one fastener aperture in the die shoe at a preselected location. The method further includes inserting the body portion of the guide pin into the central aperture of the base for precisely guiding reciprocal motion between the die pad and the die shoe, and inserting a first fastener through the fastener aperture in the base and engaging the same in the fastener aperture of the die shoe to securely, yet detachably, mount the base to the die shoe. The method further includes inserting the shoulder on the second end portion of the guide pin into the blind hole in the die pad to precisely locate the second end of the guide pin in the die pad. Finally, the method includes inserting a second fastener through the fastener aperture in the die pad and engaging the same in the fastener aperture in the second end portion of the guide pin to securely, yet detachably, connect the second end portion of the guide pin with the die pad, and positively prevent the guide pin from rotating axially relative to the die pad.

Another aspect of the present invention is a metal forming die having a die shoe, a die pad mounted a spaced apart distance from the die shoe for reciprocation between converged and diverged positions, and a biasing member disposed between the die shoe and the die pad for biasing the same to the diverged position, along with a guided keeper therefor. The guided keeper includes a base with a mounting face shaped to abut an adjacent face of the die shoe, at least one fastener aperture extending axially through a marginal portion of the base for detachably mounting the base to the die shoe, and a cylindrically shaped central aperture extending axially through a central portion of the base and having a bearing surface. The guided keeper also includes a guide pin having a first end portion with an enlarged head shaped to abut the base to positively limit travel between the die shoe and the die pad, and a cylindrically shaped body portion having a central axis, a uniform diameter extending along the entirety of the central axis thereof, selected for close reception in the central aperture of the base and a second end portion disposed opposite the first end portion with a generally flat, terminal shoulder. The shoulder has a fastener aperture extending perpendicularly through the shoulder of the guide pin and into the second end portion thereof at a location spaced radially offset from the central axis of the body portion of the guide pin, and oriented parallel therewith. A blind hole is disposed in the die pad at a preselected location and closely receives therein the shoulder of the guide pin for precisely guiding reciprocal motion between the die pad and the die shoe. At least one fastener aperture is disposed in the die pad at a preselected location which opens into the blind hole. At least one fastener aperture is disposed in the die shoe at a preselected location. A first fastener extends through the fastener aperture in the base and engages the same in the fastener aperture of the die shoe to securely, yet detachably, mount the base to the die shoe. A second fastener extends through the fastener aperture in the die pad and engages the same in the fastener aperture in the second end portion of the guide pin to securely, yet detachably, connect a second end of the guide pin with the die pad and positively prevent the guide pin from rotating axially relative to the die pad.

Yet another aspect of the present invention is a guided keeper for metal forming dies of the type having a die shoe, a die pad mounted a spaced apart distance from the die shoe for reciprocation between converged and diverged positions, and a biasing member disposed between the die shoe and the die pad for biasing the same to the diverged position. The guided keeper includes a base having a mounting face shaped to abut an adjacent face of the die shoe, at least one fastener aperture extending axially through a marginal portion of the base for detachably mounting the base to the die shoe, and a cylindrically shaped central aperture extending axially through a central portion of the base and having a bearing surface. The guided keeper also includes a guide pin having a first end portion thereof with an enlarged head shaped to abut the base to positively limit travel between the die shoe and the die pad, and a cylindrically shaped body portion having a central axis, a uniform diameter extending along the entirety of the central axis thereof for close reception in the central aperture of the base and a second end portion disposed opposite the first end portion with a generally flat, terminal shoulder configured for close reception in a blind hole in the die pad. The shoulder has a fastener aperture extending perpendicularly therethrough and into the second end portion thereof at a location spaced radially offset from the central axis of the body portion of the guide pin, and oriented parallel therewith. A first fastener extends through the fastener aperture in the base and engages the same in an associated fastener aperture in the die shoe, to securely, yet detachably, mount the base to the die shoe. The second fastener extends through an associated fastener aperture in the die pad and engages the same in the fastener aperture in the second end portion of the guide pin to securely, yet detachably, connect the second end portion of the guide pin with the die pad and positively prevent the guide pin from rotating axially relative to the die pad.

Yet another aspect of the present invention is to provide a metal forming die and associated guided keeper assembly that has a relatively small, compact footprint, with a heavy-duty construction that is very durable. The guided keeper assembly has a modular configuration that facilitates economical manufacture, and also simplifies metal forming die constructions to reduce the effort and cost of designing, manufacturing, repairing and/or modifying the same. Machine downtime is also minimized to realize yet additional efficiency. The guided keeper assembly is efficient in use, economical to manufacture, capable of a long operating life, and particularly well adapted for the proposed use.

These and other advantages of the invention will be further understood and appreciated by those skilled in the art by reference to the following written specification, claims and appended drawings.

BRIEF DESCRIPTION OF THE DRAWINGS

FIG. 58 is a fragmentary side elevational view of the guided keeper shown in FIGS. 54-57, illustrated in a disassembled condition.

FIG. 59 is a fragmentary side elevational view of the guided keeper shown in FIGS. 54-60, illustrated in a fully assembled condition.

FIG. 60 is a cross-sectional view of the guided keeper shown in FIGS. 54-59, illustrated prior to assembly in an associated die shoe.

FIG. 61 is a cross-sectional view of the guided keeper shown in FIGS. 54-60 illustrated with an installation fastener in place prior to assembly.

FIG. 62 is a cross-sectional view of the guided keeper shown in FIGS. 54-61, illustrated with the installation fastener shifted to a raised position.

FIG. 63 is a cross-sectional view of the guided keeper shown in FIGS. 54-62, illustrated with a roll pin interconnecting the guided keeper with the die shoe in a partially assembled condition.

FIG. 64 is a cross-sectional view of the guided keeper shown in FIGS. 54-63, and illustrated with the same in a fully assembled condition.

DETAILED DESCRIPTION OF PREFERRED EMBODIMENTS

Figure 1:
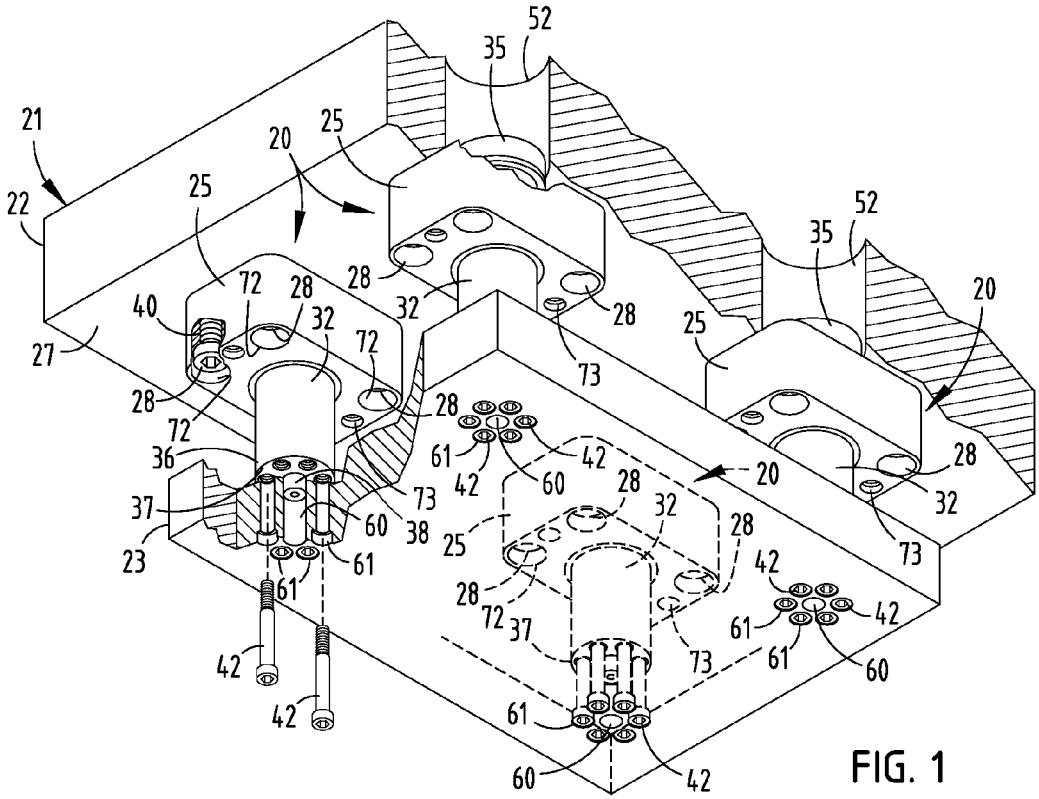
FIG. 1 PRIOR ART
FIG. 1 is a perspective view of a prior art die shoe and die pad interconnected by four guided keeper assemblies, wherein portions of the die pad and die shoe have been broken away to reveal internal construction.

For purposes of description herein, the terms "upper", "lower", "right", "left", "rear", "front", "vertical", "horizontal" and derivatives thereof shall relate to the illustrated inventions as oriented in the drawings. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
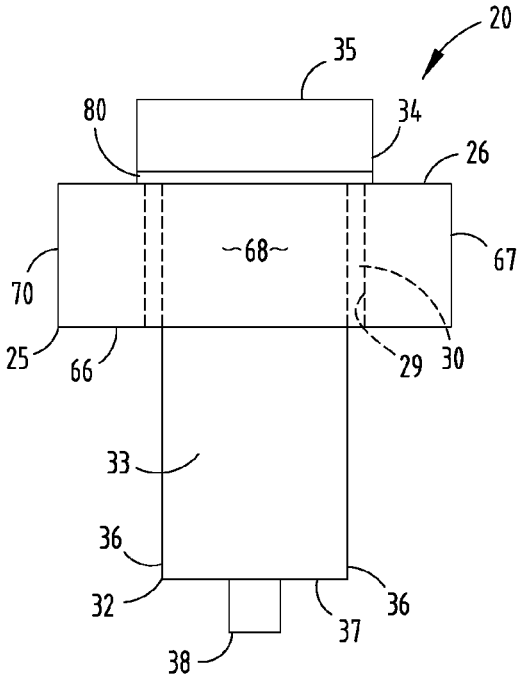
FIG. 2 PRIOR ART
FIG. 2 is a side elevational view of one of the guided keeper assemblies embodying the prior art.
Figure 3:
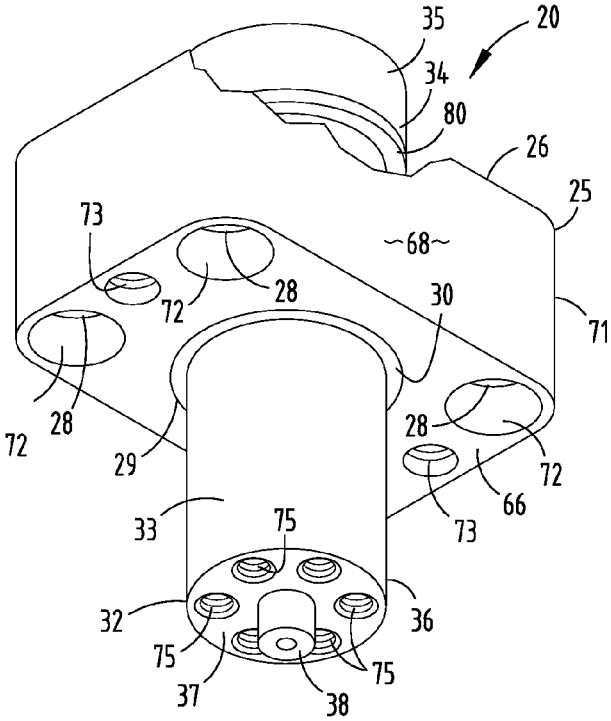
FIG. 3 PRIOR ART
FIG. 3 is a bottom perspective view of the prior art guided keeper assembly shown in FIG. 2, wherein a portion thereof has been broken away to reveal internal construction.
Figure 4:
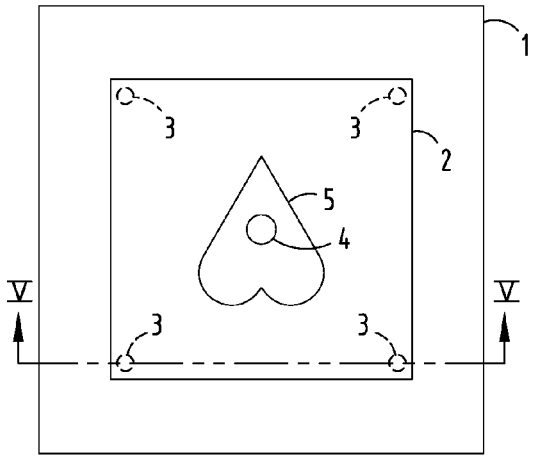
FIG. 4 PRIOR ART
FIG. 4 is a partially schematic, plan view of a prior art metal forming die.
Figure 5:
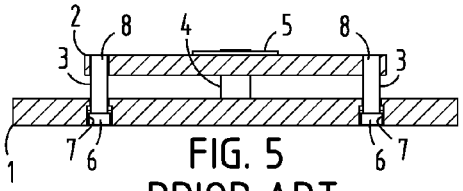
FIG. 5 PRIOR ART
FIG. 5 is a side elevational view of the prior art metal forming die shown in FIG. 4.
Figure 6:
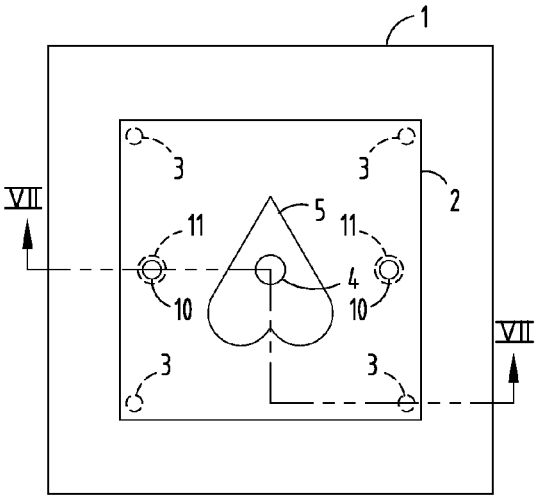
FIG. 6 PRIOR ART
FIG. 6 is a partially schematic plan view of an alternative prior art metal forming die.
Figure 7:
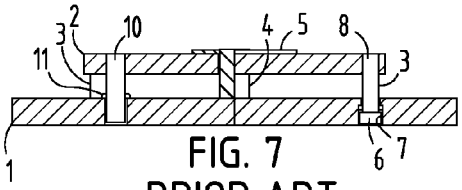
FIG. 7 PRIOR ART
FIG. 7 is a side elevational view of the prior art metal forming die shown in FIG. 6.
Figure 8:
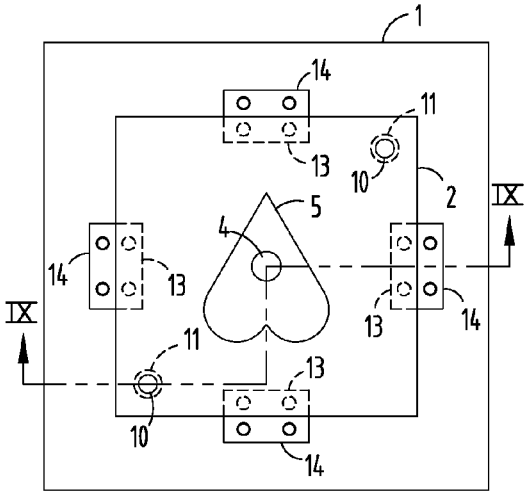
FIG. 8 PRIOR ART
FIG. 8 is a partially schematic plan view of yet another alternative prior art metal forming die.
Figure 9:
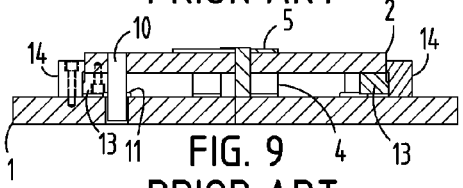
FIG. 9 PRIOR ART
FIG. 9 is a side elevational view of the prior art metal forming die shown in FIG. 8.
Figure 17:
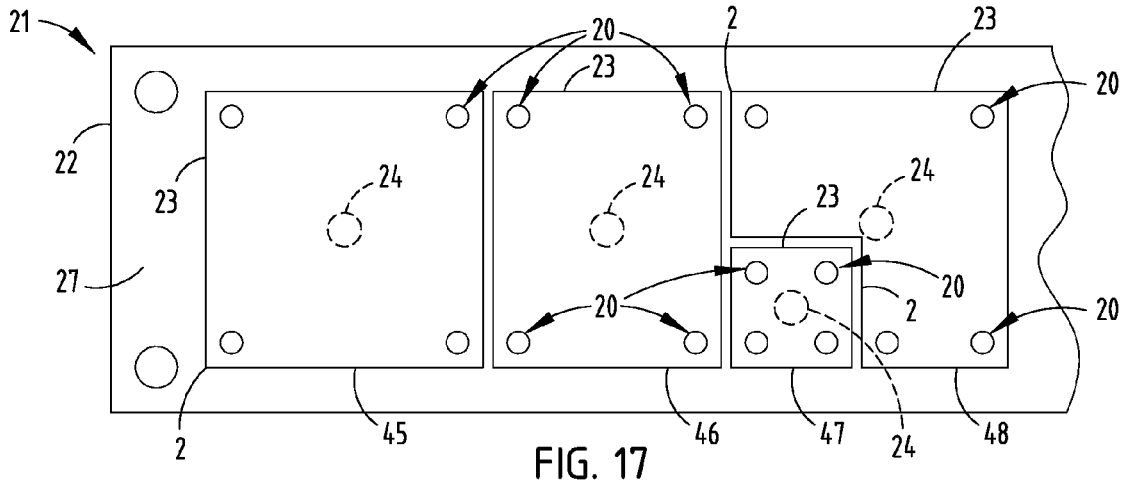
FIG. 17 PRIOR ART
FIG. 17 is a partially schematic plan view of a prior art metal forming die having a plurality of stations each with die pads connected to the die shoe by the guided keeper assemblies.
Figure 18:
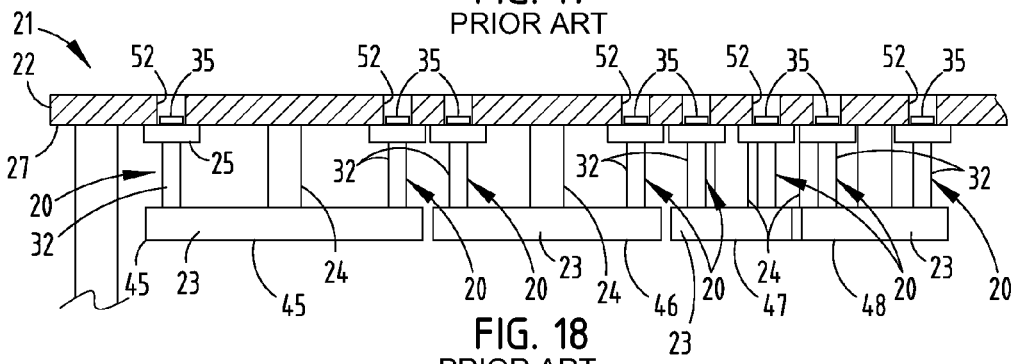
FIG. 18 PRIOR ART
FIG. 18 is a partially schematic side elevational view of the metal forming die shown in FIG. 17.

The reference numeral 20 (FIGS. 1-3) generally designates a guided keeper assembly embodying the present invention, which is particularly adapted for use in conjunction with metal forming dies, such as the die set or die 21 illustrated in FIG. 1, having a die shoe 22 and a die pad 23 mounted a spaced apart distance from die shoe 22 for reciprocation between converged and diverged positions. A biasing member 24, which is schematically illustrated in FIGS. 17 and 18, is disposed between die shoe 22 and die pad 23 for biasing the same to the diverged position. Guided keeper assembly 20 (FIGS. 1-3) includes a base block 25 having a generally flat mounting face 26 abutting an adjacent face 27 of die shoe 22. Base block 25 has at least one non-threaded fastener aperture 28 extending axially through a marginal portion of base block 25 for detachably mounting base block 25 to die shoe 22. Base block 25 also includes a central aperture 29 extending axially through a central portion of base block 25, and a bushing 30 mounted in the central aperture 29 of base block 25. Guided keeper assembly 20 also includes a guide pin 32 having a cylindrically-shaped central portion 33 closely received in bushing 30 in base block 25 for precisely guiding reciprocal motion between die pad 23 and die shoe 22. Guide pin 32 also includes a first end 34 having an enlarged head 35 shaped to abut the mounting face 26 of base block 25 to positively limit travel between die shoe 22 and die pad 23. Guide pin 32 also includes a second end 36, positioned opposite the first end 34, and having a shoulder 37 with a rigid center post 38 protruding outwardly therefrom to precisely locate the second end 36 of guide pin 32 in die pad 23. A first fastener 40 extends through the fastener aperture 28 in base block 25 and securely, yet detachably, connects base block 25 with die shoe 22. A second fastener 42 securely, yet detachably, connects the second end 36 of guide pin 32 with die pad 23.

In the example illustrated in FIGS. 17 and 18, die 21 is an upper die half, and includes four separate stations 45-48, each having a separate die pad 23 attached to a common upper die shoe 22 by a plurality of guided keeper assemblies 20. In the illustrated example, each of the die pads 23 is attached to the common die shoe 22 by four guided keeper assemblies 20 disposed adjacent corner portions of the die pads 23. However, it is to be understood that the precise number of guided keeper assemblies and their particular location on the die pad 23 will vary in accordance with the particular application. Also, guided keeper assemblies 20 can be used on the lower die shoe, and other similar applications, as will be apparent to those skilled in the art.

Figure 10:
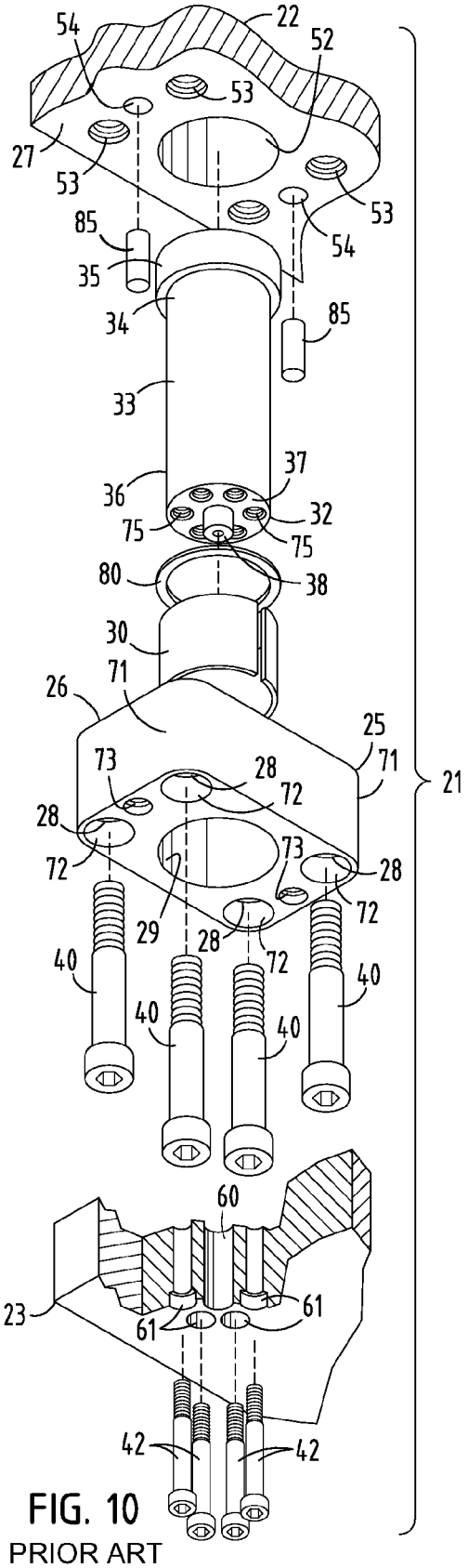
FIG. 10 PRIOR ART
FIG. 10 is an exploded perspective view of a prior art guided keeper assembly shown with associated fragmentary portions of the die shoe and die pad.
Figure 11:
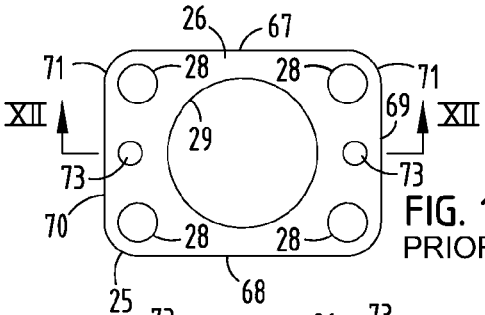
FIG. 11 PRIOR ART
FIG. 11 is a top plan view of a base block portion of the prior art guided keeper assembly.
Figure 12:
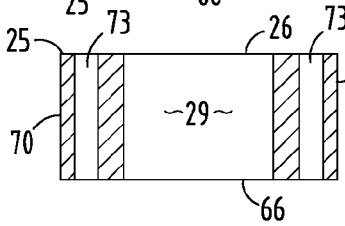
FIG. 12 PRIOR ART
FIG. 12 is a vertical cross-sectional view of the base block taken along the line XII-XII, FIG. 11.
Figure 13:
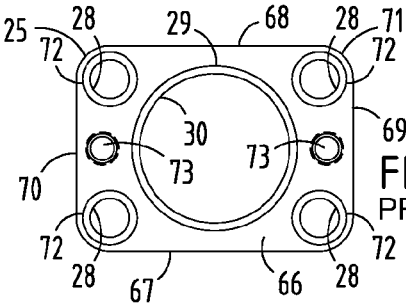
FIG. 13 PRIOR ART
FIG. 13 is a bottom plan view of the base block.

As best illustrated in FIG. 10, at each position or location the guided keeper assembly 20 is to be installed, die shoe 22 is prepared in the following manner. A circular clearance or through hole 52 is formed through die shoe 22 in vertical axial alignment with the position at which the guided keeper assembly 20 is to be installed. Through hole 52 has a diameter slightly larger than the head 35 of guide pin 32 to permit free reciprocation of guide pin 32 therein. The formation of through hole 52 is relatively simple, since it can be formed in a single boring operation, and need not be precise, since there is substantial clearance between the head 35 of guide pin 32 and the interior of through hole 52.

In the example illustrated in FIG. 10, four threaded fastener apertures 53 are formed in the surface 27 of die shoe 22, and are arranged around through hole 52 in a quadrilateral pattern for purposes to be described in greater detail hereinafter. Also, in the embodiment illustrated in FIG. 10, two locator apertures 54 are formed in the surface 27 of die shoe 22 on opposite sides of through hole 52 to precisely locate base block 25 on die shoe 22 in the manner described in greater detail hereinafter. Preferably, locator apertures 54 are reamed to provide improved precision.

In the arrangement illustrated in FIG. 10, die pad 23 is prepared in the following manner. A precision circular locator aperture 60 is formed through die pad 23 at a position in vertical alignment with the location at which the guided keeper assembly 20 is to be installed. Locator aperture 60 is a through hole, and is formed with a precise diameter shaped through reaming or the like, to closely receive the center post 38 of guide pin 32 therein to accurately locate the second end 36 of guide pin 32 on die pad 23. In the illustrated example, six non-threaded fastener apertures 61 are formed through die pad 23, and are arranged in a circumferentially spaced apart pattern that is concentric with the locator aperture 60. Fastener apertures 61 have enlarged outer ends to receive the heads of fasteners 42 therein, and serve to securely, yet detachably, mount the second end 36 of guide pin 32 to die pad 23 in a manner described in greater detail hereinafter.

The illustrated base block 25 (FIGS. 10-13) is made from steel, and has a generally rectangular plan configuration defined by an upper surface 26, a lower surface 66 and sidewalls 67-70 which intersect at radiused corners 71. The illustrated base block 25 includes four non threaded fastener apertures 28 positioned adjacent each of the corners 71 of base block 25. Fastener apertures 28 are mutually parallel and are arranged in a rectangular pattern identical to that of the threaded fastener apertures 53 on die shoe 22, such that fastener apertures 28 are in vertical alignment with threaded fastener apertures 53. The lower or die pad ends of fastener apertures 28 have enlarged counter bored portions 72 to receive therein the heads of fasteners 40. The illustrated base block 25 also includes two locator apertures 73 which are formed through base block 25 and are arranged in a mutually parallel relationship for vertical alignment with the locator apertures 54 in die shoe 22. The illustrated base block 25 has a relatively small, compact plan configuration to facilitate die manufacture, and also permits the same to be pocketed or recessed into the die shoe 22, if necessary, for a specific application.

The illustrated bushing 30 (FIG. 10) is a maintenance-free split bushing, constructed from a suitable antifriction material, such as bronze, steel alloys or the like. In the uninstalled condition, the outside diameter of bushing 30 is slightly larger than the interior diameter of central aperture 29, such that bushing 30 is press fit into the central aperture 29 of base block 25 and is securely retained therein by a friction fit. The inside diameter of bushing 30 is slightly greater than the outside diameter of the central portion 33 of guide pin 32, such as 0.0010-0.0020 inches, to accommodate for thermal expansion between the guide pin 32 and the bushing 30, yet maintain precise reciprocal alignment between die shoe 22 and die pad 23. The use of a separate bushing 30 permits base block 25 to be made from high strength steel and the like, thereby providing a much stronger assembly than those constructed from a single, softer material, such as bonze or the like.

As will be appreciated by those skilled in the art, bushing 30 may be formed integrally into base block 25, or omitted entirely by forming the bearing or guide surface for guide pin 32 in base block 25. For example, base block 25 could be constructed from bronze, or other similar antifriction materials, such that central aperture 29 itself forms the guide surface. Alternatively, the central aperture 29 of base block 25 can be plated or otherwise coated with an antifriction material to eliminate the need for a separate bushing 30.

Figure 14:
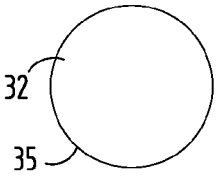
FIG. 14 PRIOR ART
FIG. 14 is a top plan view of a guide pin portion of the prior art guided keeper assembly.
Figure 15:
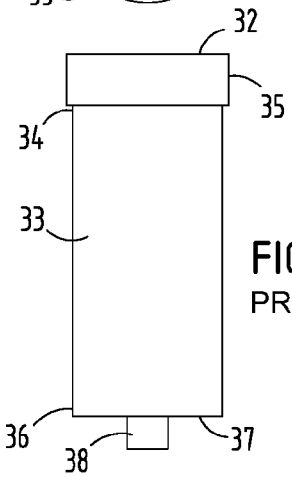
FIG. 15 PRIOR ART
FIG. 15 is a side elevational view of the guide pin.
Figure 16:
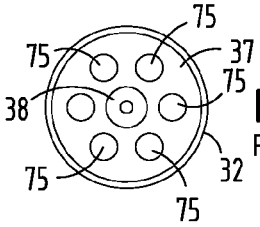
FIG. 16 PRIOR ART
FIG. 16 is a bottom plan view of the guide pin.

The illustrated guide pin 32 (FIGS. 10 and 14-16) has a generally cylindrical shape, which in the orientation illustrated in FIGS. 14-16, has enlarged head 35 attached to the upper or first end 34 of guide pin 32 and center post 38 protruding downwardly from the lower or second end 36 of guide pin 32. The illustrated shoulder 37 and center post 34 are formed integrally in the lower end 36 of guide pin 32, and center post 37 is precisely located at the center of shoulder 37 in a concentric relationship. The lowermost end of the illustrated center post 38 is flat with a circular indentation at the center which facilitates precise location and formation of center post 38 on guide pin 32. The illustrated center post 38 is accurately machined to a tolerance of 0.0-0.0005 inches. In the example illustrated in FIGS. 10 and 14-16, six threaded fastener apertures 75 are formed in the flat, radially extending shoulder 37 of guide pin 32 in a circumferentially spaced apart pattern that is concentric with center post 38. Threaded fastener apertures 75 are positioned to align vertically with the six non-threaded fastener apertures 61 and die pad 23. In one working embodiment of the present invention, guide pin 32 is constructed from pre hardened 4140 steel, or the like, is cut to length and formed, and then case hardened and polished.

With reference to FIG. 10, the illustrated guided keeper assembly 20 includes an annularly-shaped, resilient washer or ring 80 that is disposed on guide pin 32 between enlarged head 35 and the mounting face 26 of base block 25. Resilient washer 80 serves to absorb impact between head 35 and base block 25 during operation, and can be constructed from urethane, or the like.

In operation, guided keeper assemblies 20 are used to quickly and easily interconnect die shoe 1 and die pad 2 for reciprocation between converged and diverged positions. At least two guided keeper assemblies 20 are typically used to mount die pad 2 to die shoe 1. However, it is to be understood that the specific number of guided keeper assemblies 20 used depends upon the specific die application. In any event, the die shoe 1 is prepared in the manner described hereinabove by providing the clearance or through hole 52, four threaded fastener apertures 53 and two locator apertures 54 at each location at which guided keeper assembly 20 is to be installed. Similarly, die pad 2 is prepared by forming one locator aperture 60 and six unthreaded fastener apertures 61 at each location guided keeper assembly 20 is to be installed. The base blocks 25 are then mounted to the surface 27 of die shoe 22 at each of the designated locations by installed threaded fasteners 40 which are then inserted through fastener apertures 28 and anchored in the threaded fastener apertures 53 in die shoe 22. The illustrated fasteners 40 are cap screws with nylon pellets which resist inadvertent loosening in die shoe 22. Alignment dowels or pins 85 may be mounted in die shoe 22 and received in locator apertures 54 and 72 to achieve additional precision in locating base blocks 25 on die shoe 22. Guide pins 32, with resilient washers 80 installed thereon, are then inserted through the bushings 30 in each of the base blocks 25. The center post 38 at the lower end 36 of each guide pin 32 is received closely within the locator apertures 60 in die pad 23. Threaded fasteners 42 are then inserted through the fastener apertures 61 in die pad 23 and anchored in the threaded fastener apertures 75 in the shoulder portion 37 of guide pin 32 to securely, yet detachably, connect the lower end of guide pin 32 with die pad 23.

Figure 19:
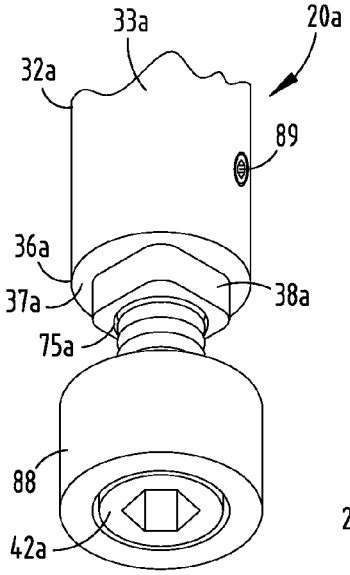
FIG. 19 PRIOR ART
FIG. 19 is a fragmentary, perspective view of another prior art embodiment.
Figure 20:
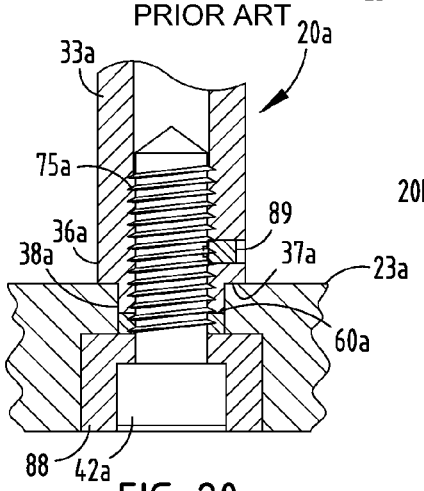
FIG. 20 PRIOR ART
FIG. 20 is a fragmentary, vertical cross-sectional view of the guided keeper assembly shown in FIG. 19, illustrated attached to a die pad.
Figure 21:
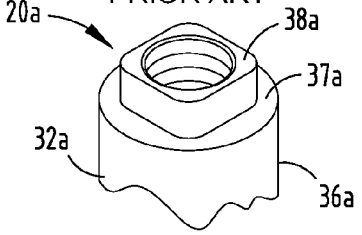
FIG. 21 PRIOR ART
FIG. 21 is a fragmentary, top perspective view of a guide pin portion of the guided keeper assembly shown in FIGS. 19 and 20.

The reference numeral 20*a* (FIGS. 19-21) generally designates another embodiment of the present invention, having a single fastener 42*a* at the shoulder end 36*a* of guide pin 32*a*. Since guided keeper assembly 20*a* is similar to the previously described guided keeper assembly 20, similar parts appearing in FIGS. 20-21, 1-3 and 10-16, respectively, are represented by the same, corresponding reference numerals, except for the suffix "a" in the numerals of the latter. In guided keeper assembly 20*a*, the lower or shoulder end 36*a* of guide pin 32*a* includes a center post 38*a* having a non circular plan configuration, which is designed to prevent rotation of guide pin 32*a* relative to the associated die pad 23*a*. In the illustrated example, the center post 38*a* of guide pin 32*a* has a generally square plan configuration with radiused or rounded corners. Furthermore, a single threaded fastener aperture 75*a* is formed concentrically through shoulder 37*a* and into guide pin 32*a*, and is adapted to receive therein a single threaded fastener 42*a* along with annularly-shaped cap or locking collar 88. A set screw 89 extends radially through the side of guide pin 32*a* to facilitate removal of base block 25, and positively retain fastener 42*a* in threaded fastener aperture 75*a*. Die pad 23*a* is prepared with a non-circular locator aperture 60*a* to closely receive the center post 38*a* of guide pin 32*a* therein and prevent axial rotation therebetween.

Figure 22:
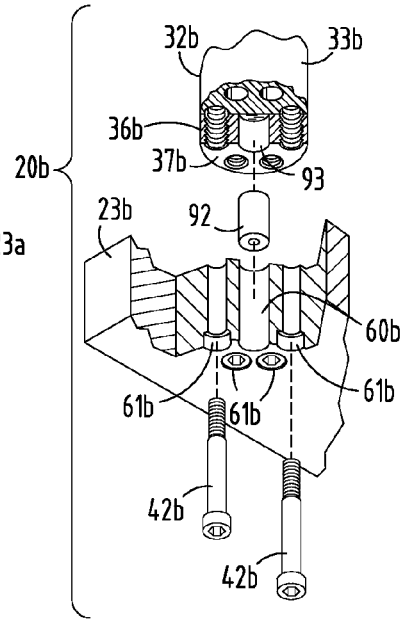
FIG. 22 PRIOR ART
FIG. 22 is an exploded side elevational view of yet another prior art embodiment having an alignment pin connecting the guide pin with the die pad.
Figure 23:
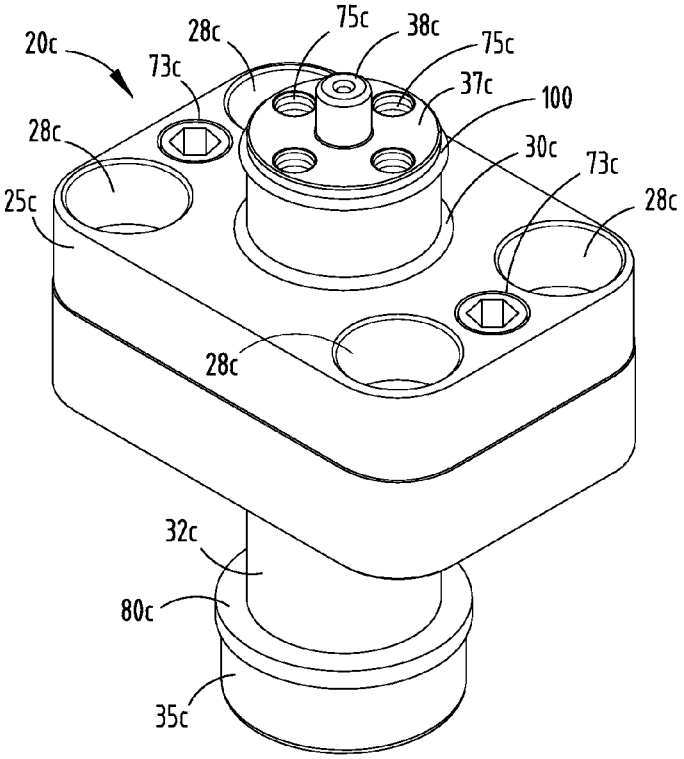
FIG. 23 is a perspective view of yet another embodiment of the present invention having a retainer ring which retains the base on the guide pin in an assembled condition.
Figure 24:
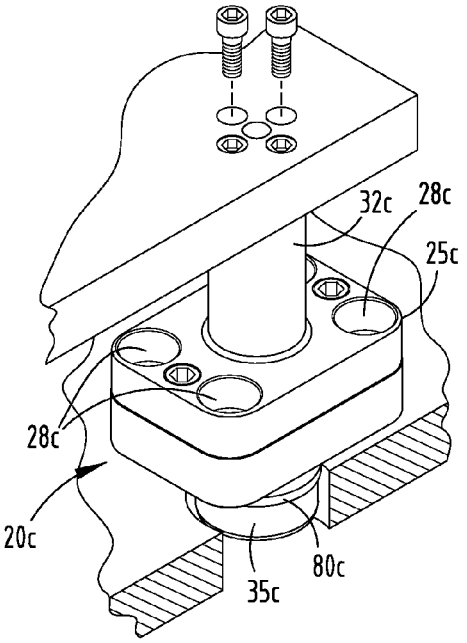
FIG. 24 is a perspective view of the guided keeper assembly shown in FIG. 23, illustrated being attached to an associated die.

The reference numeral 20*b* (FIG. 22) generally designates yet another embodiment of the present invention having a removable locator pin 92 at the shoulder end 36*b* of guide pin 32*b*. Since guided keeper assembly 20*b* is similar to the previously described guided keeper assembly 20, similar parts appearing in FIG. 22, FIGS. 1-3 and 10-16, respectively, are represented by the same, corresponding reference numerals, except for the suffix "b" in the numerals of the latter. In guided keeper assembly 20*b*, a cylindrical recess 93 is formed in the end 37*b* of guide pin 32*b*, instead of center post 38*b*. In the illustrated example, recess 93 has a generally circular plan configuration, and is precisely formed in the center of the shoulder 37*b* of guide pin 32*b*. A mating through aperture 60*b* is formed through die pad 23*b* in vertical alignment with recess 93. A separate, cylindrical locator pin 92 has one end closely received in recess 93, and the opposite end closely received in locator aperture 60*b*, so as to precisely locate the shoulder end 36*b* of guide pin 32*b* in die pad 23*b*.

Figure 25:
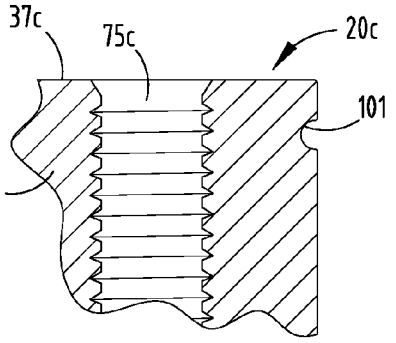
FIG. 25 is an enlarged, fragmentary cross-sectional view of a guide pin portion of the guided keeper assembly shown in FIGS. 23 and 24.
Figure 26:
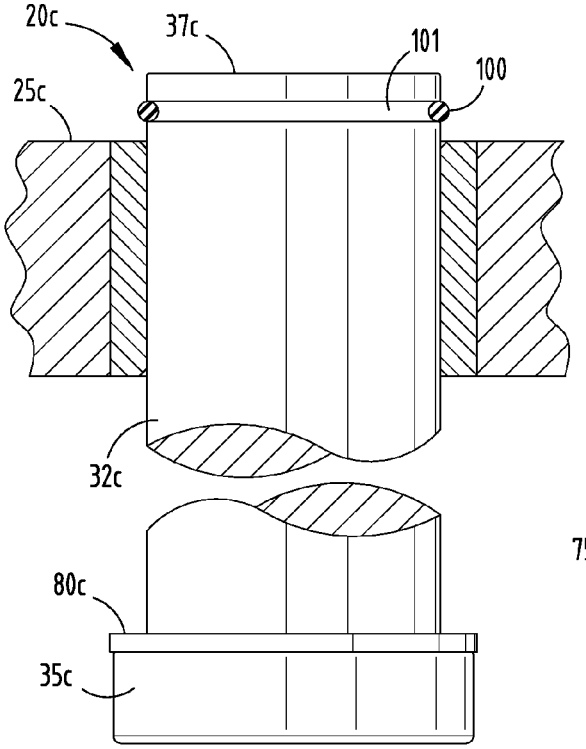
FIG. 26 is a fragmentary cross-sectional view of the guided keeper assembly shown in FIGS. 23-25.
Figure 27:
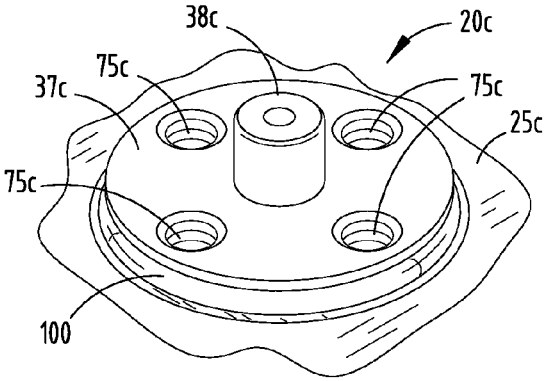
FIG. 27 is an enlarged, fragmentary view of the guided keeper assembly shown in FIGS. 23-26.
Figure 28:
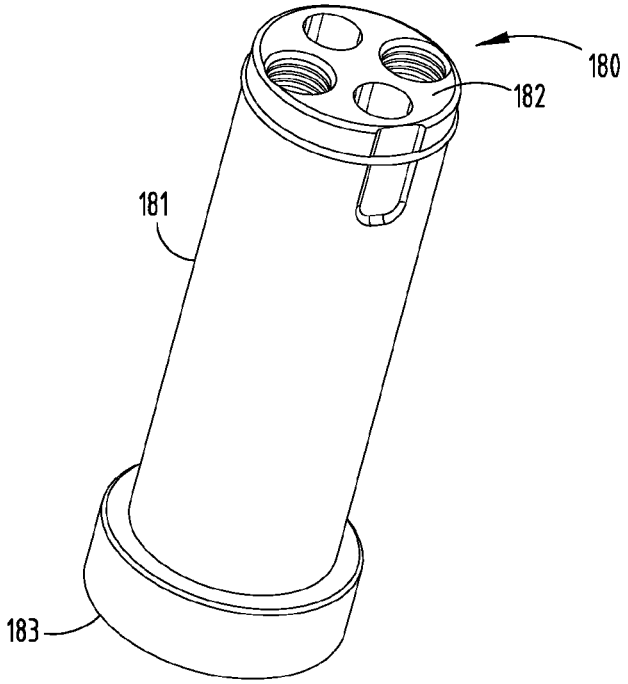
FIG. 28 is a perspective view of an integrally formed, one-piece guide pin.
Figure 29:
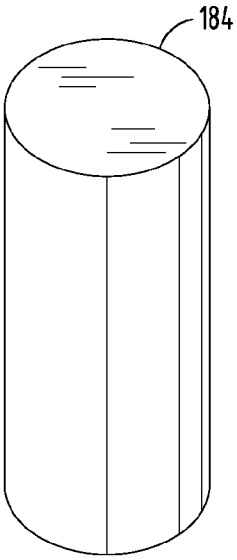
FIGS. 29-32 are perspective views which illustrate the processing steps used to make the one-piece guide pin illustrated in FIG. 28.

The reference numeral 20*c* (FIGS. 23-27) generally designates yet another embodiment of the present invention having a retainer ring 100 which retains the base 25*c* on the guide pin 32*c* between the enlarged head 35*c* and the retainer ring 100 in an assembled condition to facilitate transport and mounting of the guided keeper assembly 20*c*. Since guided keeper assembly 20*c* is similar to the previously described guided keeper assembly 20, similar parts appearing in FIGS. 23-27 and FIGS. 1-18, respectively, are represented by the same, corresponding reference numerals, except for the suffix "c" in the numerals of the latter. In guided keeper assembly 20*c*, a radially outwardly opening groove 101 extends circumferentially about the second end 36*c* of guide pin 32*c*. As best illustrated in FIG. 25, groove 101 has a generally U-shaped configuration, and is positioned axially immediately adjacent to the flat shoulder 37*c* on guide pin 32*c* to avoid interfering with the reciprocation of die pad 2*c*. Retainer ring 100 is removably mounted in groove 101 and protrudes radially outwardly of the second end 36*c* of guide pin 32*c* to securely, yet detachably, retain base 25*c* on guide pin 32*c* between head 35*c* and retainer ring 100 in an assembled condition to create a semi-permanent assembly which facilitates transport and mounting of the guided keeper assembly 20*c*. The base 25*c*, guide pin 32*c* and washer 80*c* can be disassembled only after removal of retainer ring 100 from guide pin grove 101. In the illustrated example, retainer ring 100 comprises a resilient ring sized to selectively snap fit into groove 101. In one example of the present invention, retainer ring 100 is a flexible O-ring that is constructed from a relatively soft material so as to absorb impact with base 25*c*. As in guided keeper assembly 20, a resilient washer 80*c* is disposed on guide pin 32*c* between enlarged head 35*c* and the mounting face 26*c* of base 25*c* to absorb impact therebetween. The illustrated guided keeper assembly 1*c* has a block-shaped base block

25*c*, and is mounted to an associated die shoe 1*c* in a manner similar to that described above relative to guided keeper assembly 20. Guided keeper assembly 20*c* is particularly beneficial when the same is mounted to a die member in the orientation illustrated in FIG. 24, where the head 35*c* of guide pin 32*c* is oriented downwardly, and the alignment end 36*c* is oriented upwardly. When guide pin 32*c* is unbolted from die block 1*c*, O-ring 100 prevents the guide pin 32*c* from falling through base 25*c*.

Figure 30:
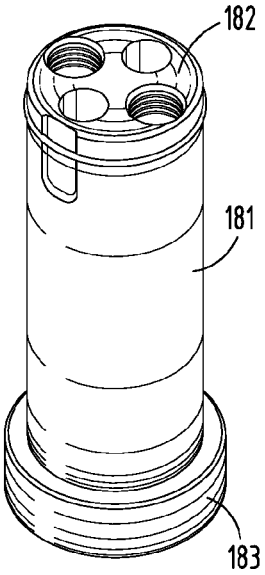
Figure 31:
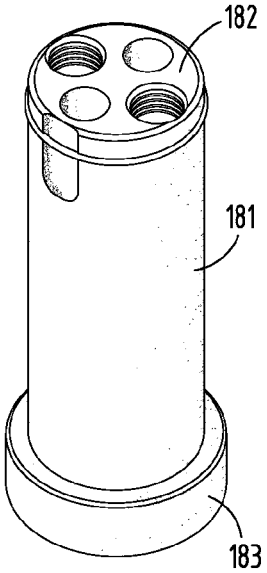
Figure 32:
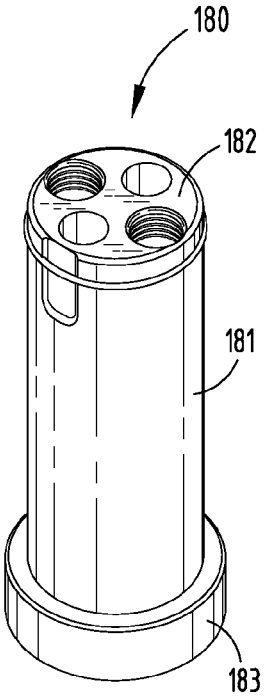
Figure 33:
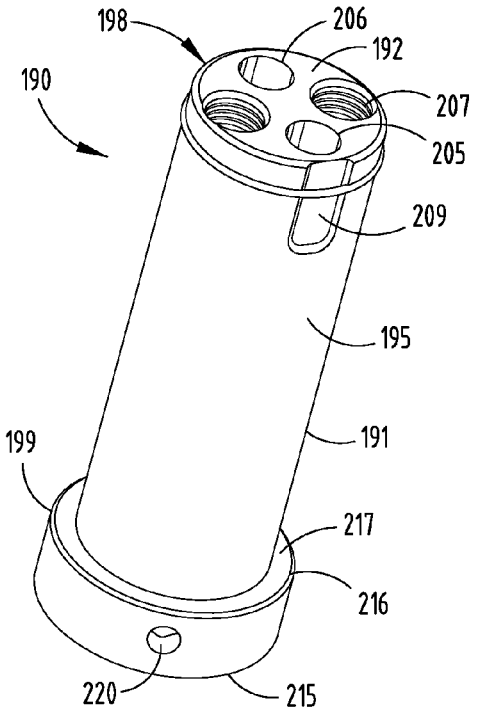
FIG. 33 is a perspective view of a two-piece guide pin embodying the present invention.
Figure 34:
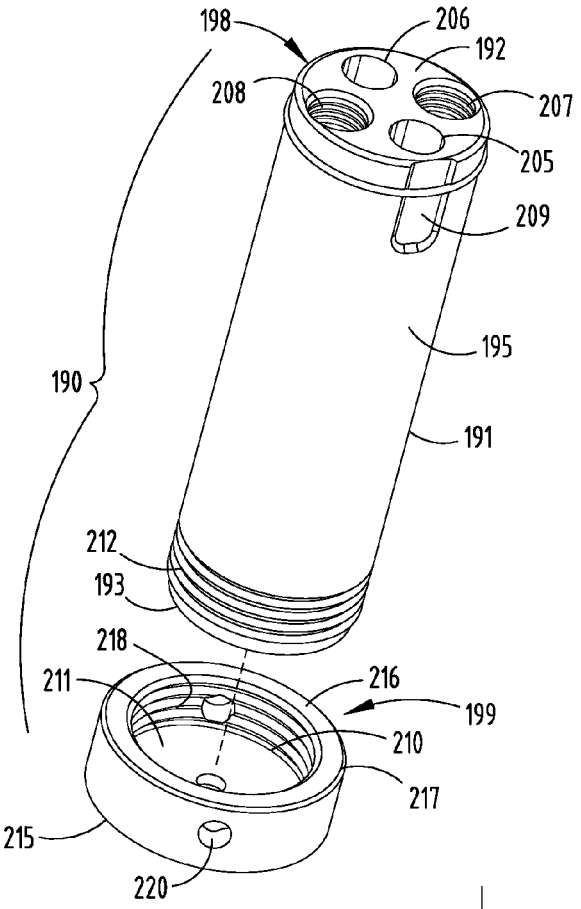
FIG. 34 is an exploded perspective view of the two-piece guide pin.

FIGS. 28-32 illustrate an integrally formed, one-piece guide pin 180 and associated method, which is somewhat similar to previously described guide pin 32, insofar as it has a generally cylindrical shaped body portion 181, with an alignment member 182 formed integrally at one end of guide pin body 181, and an enlarged head 183 formed integrally at the opposite end of guide pin body 181. As best illustrated in FIGS. 29-32, one-piece guide pin 180 is integrally formed from a solid bar 184 of hardenable steel having a cylindrical shape with an oversized outside diameter that is substantially commensurate with the outside diameter of the enlarged head 183. The cut length of the oversized bar 184 is determined in accordance with the desired height of the one-piece guide pin 180. The cut length of oversized bar stock 184 is precision machined, as shown in FIG. 30, to create the integral body 181 and head 183. Since the guide pin body reciprocates in an associated die bore for precisely guiding reciprocal motion between an associated die pad and die shoe, the exterior surface thereof must be hard and very accurate in shape and size to achieve the necessary low friction bearing and precision guide functions. The alignment member 182 is formed on that end of the one-piece guide pin 180 disposed opposite integrally formed head 183. Next, the precision machined guide pin 180 must be heat treated through nitride hardening or the like, as shown in FIG. 31. Because the nitride hardening process roughens the outside surface of the one-piece guide pin 180, at least the body portion 181 thereof must then be individually polished to facilitate close reception and sliding reciprocation in the associated die member bore. While one-piece guide pin 180 and the associated method are generally effective, the same are complicated and rather expensive. More specifically, the machining of the oversized bar material 184 requires holding a very tight tolerance on the machined guide pin body diameter. Substantial waste of material is also experienced during the machining process, since the guide pin 181 is typically much longer than the guide pin head 183. The formed part then needs to be transported to a specialty processor to be nitrated or the like to harden the outer surface of the guide pin body 181. The nitride process leaves a gray film on the entire surface of the guide pin 180, which requires a secondary polishing process by hand or otherwise. As a result, the lead time needed to produce one-piece guide pin 180 is relatively high, because of the heat treatment process after the part is machined, thereby requiring retailers to inventory substantial quantities of differently sized guide pins to meet customer demands. Furthermore, the required hand polishing adds significant time and cost to the manufacture of the one-piece guide pin 180. Hence, a guide pin construction and associated method which simplify the manufacturing process, reduce lead time and inventories, and reduce costs, as well as improve performance, would clearly be advantageous.

The reference numeral 190 (FIGS. 33-37) generally designates yet another embodiment of the present invention, having a two-piece guide pin construction. Two-piece guide pin 190 (FIGS. 33-37) includes a guide pin body 191 having first and second ends 192 and 193, and is formed from a cut length of an elongate, solid bar of steel guide pin body stock 194 (FIG. 38) having a cylindrical shape and a hard and smooth finished exterior surface 195 with a predetermined outside diameter selected for close reception in an associated die member bore, such as the central aperture 29 of base block 25, for precisely guiding reciprocal motion between die pad 2 and die shoe 1. An alignment member 198 (FIGS. 33-37) is formed on the first end 192 of guide pin body 191 to precisely locate the first end 192 of the guide pin 190 on an associated die plate. Two-piece guide pin 190 also includes a separate guide pin head 199 formed from a cut length of an associated solid bar 200 of guide pin head stock having a predetermined outside diameter that is substantially greater than the outside diameter of the bar of guide pin body stock 194. The guide pin head 199 is rigidly connected to the second end 193 of the guide pin body 191 in a generally concentric relationship to define an enlarged head that serves to positively limit travel between the die shoe 1 and the die pad 2.

In the example illustrated in FIGS. 33-42, guide pin body 199 is made from an elongate, solid bar of steel which has been plated or otherwise coated with a hard and smooth material, such as chrome or the like, thereby creating a mirror-like finish that is particularly adapted to facilitate close, low friction, sliding reception in an associated die member bore for precisely guiding reciprocal motion between the die pad 2 and the die shoe 1. The outside diameter of the guide pin body bar stock 194 is selected to be exactly the same as the finished outside diameter of the guide pin body 191, such that a plurality of guide pin body blanks 196 (FIG. 38) can be cut from a single bar of stock 194, and do not require further surface hardening or hand polishing, as was required in prior art processing. The outside surface 195 of the guide pin body stock 194 may be power polished in a buffing machine or the like, before the bar of stock 194 is cut lengthwise into individual blanks 196. Furthermore, the cutoff step in forming the individual guide pin body blanks 196 does not require high tolerances, and can be made with one setup on a general purpose lathe, since the bar stock 194 does not require machining to a reduced diameter. In the illustrated two-piece guide pin, a small pin-shaped cutoff nub 197 is formed about the axial center of the second end 193 of guide pin body 181 when the cutoff tool reaches the depth at which the thin connection between the blank 196 and the balance of the bar stock 184 breaks under its own weight, along with the dynamics of the cutoff process. Preferably, this cutoff nub 197 is simply left in place on guide pin body 181, so as to avoid the effort, time and expense of removing the same, as described further below. Also, the amount of material waste that is experienced in the manufacture of prior art one-piece guide pins is virtually eliminated.

In the example illustrated in FIGS. 33-42, the alignment member 198 comprises two axially extending locator apertures 205 and 206 and two oppositely disposed fastener apertures 207 and 208. However, it is to be understood that other alignment member constructions, including those disclosed herein, could also be used at the first end 192 of guide pin body 191 to precisely locate the first end of the guide pin on an associated die plate. The illustrated guide pin body 191 also includes a pair of flats 209 disposed in a diametrically opposite relationship adjacent the first end 192 of guide pin body 191 for purposes of facilitating engagement by a tool to retain the guide pin body 191 in place during assembly.

The illustrated guide pin body 191 has an external thread 212 formed on the exterior surface 195 at a location adjacent to the second end 193 of guide pin body 191. In the illustrated example, the threads are relatively deep cut and coarse to facilitate forming a very strong threaded connection with guide pin head 199.

The illustrated guide pin head 199 (FIGS. 33-37) has a generally cylindrical or disk shape, comprising an exterior face 215, an interior face 216 and a sidewall 217. A cup-shaped recess 210 is formed in the interior face 216 of guide pin head 199, and has a circular top plan shape, and a bottom wall 211. An internal thread 218 is formed in the sidewall 217 of the recess 211 in guide pin head 199, which mates with the external thread 212 on the second end 193 of guide pin body 191. The illustrated guide pin head 199 also includes a pair of radially oriented apertures 220 which extend through sidewall 217 and communicate with the recess 211 formed in the exterior face 216, and facilitate permanently attaching the guide pin head to the guide pin body, as disclosed in greater detail hereinafter. In the illustrated example, the bottom wall 211 of guide pin head 199 includes a blind hole 221 disposed about the axial center thereof, which has a width and depth sufficient to wholly receive therein the cutoff nub 197 on the second end 193 of the guide pin body 181. Blind hole 221 permits the guide pin head 199 to be threaded fully onto the second end of guide pin body 191, without removing the cutoff nub 197.

Figure 35:
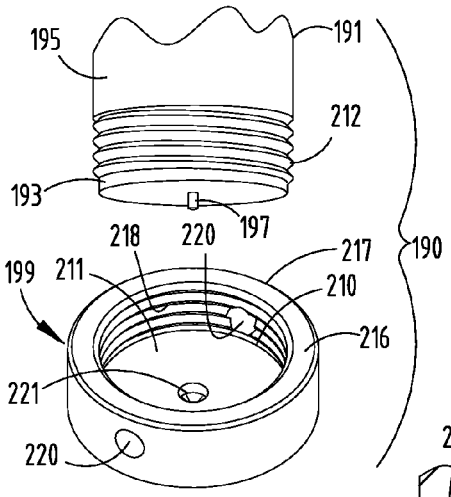
FIG. 35 is an enlarged, fragmentary, exploded perspective view of one end of the two-piece guide pin, shown prior to assembly.
Figure 36:
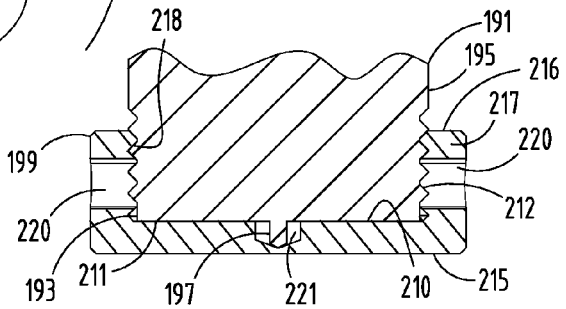
FIG. 36 is an enlarged, fragmentary, cross-sectional view of one end of the two-piece guide pin, showing the guide pin head and the guide pin body in an assembled condition.
Figure 37:
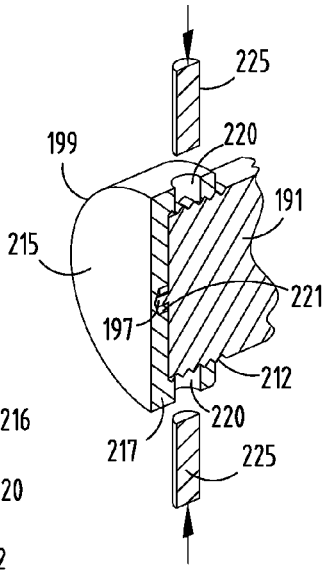
FIG. 37 is a fragmentary, cross-sectional view of one end of the two-piece guide pin, showing the guide pin head and guide pin body in an assembled condition, and staking tools to permanently interconnect the same.
Figure 38:
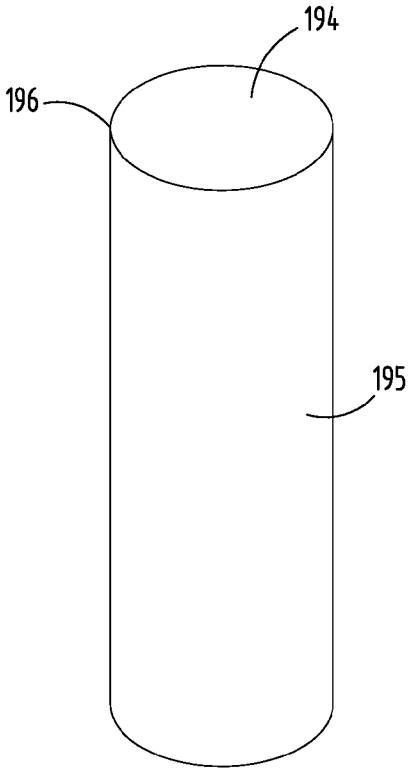
FIG. 38 is a perspective view of a guide pin bar stock used to make the two-piece guide pin.
Figure 39:
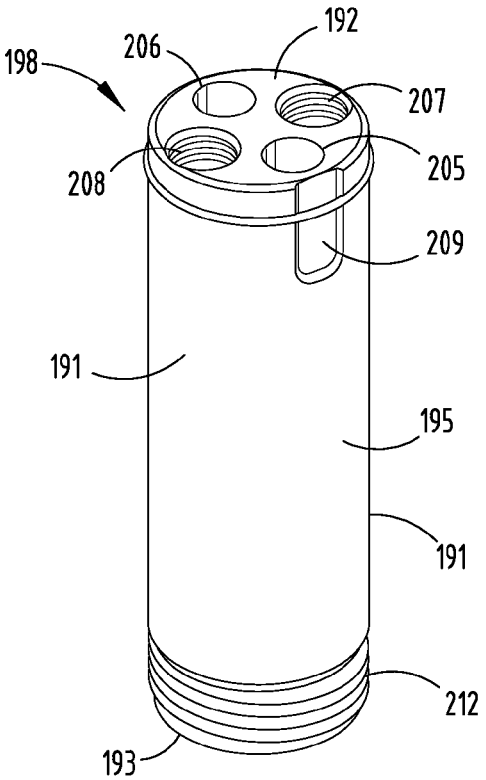
FIG. 39 is a perspective view of the guide pin body portion of the two-piece guide pin.
Figure 40:
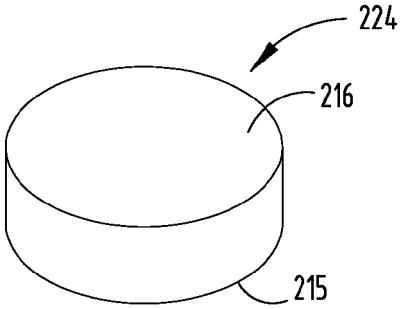
FIG. 40 is a perspective view of the guide pin head portion of the two-piece guide pin, taken from an exterior side thereof.
Figure 42:
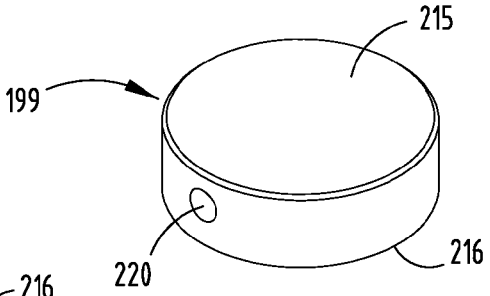
FIG. 42 is a perspective view of the guide pin head portion of the two-piece guide pin, taken from an exterior side thereof, and shown after an etching process for marking the same.
Figure 41:
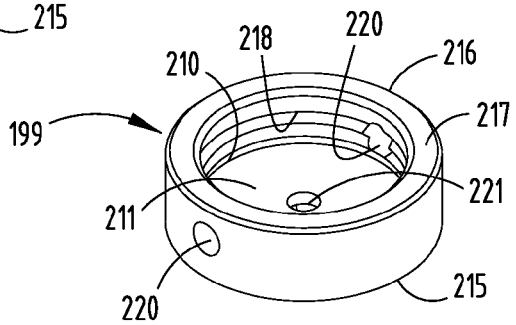
FIG. 41 is a perspective view of the guide pin head portion of the two-piece guide pin, taken from an interior portion thereof.
Figure 43:
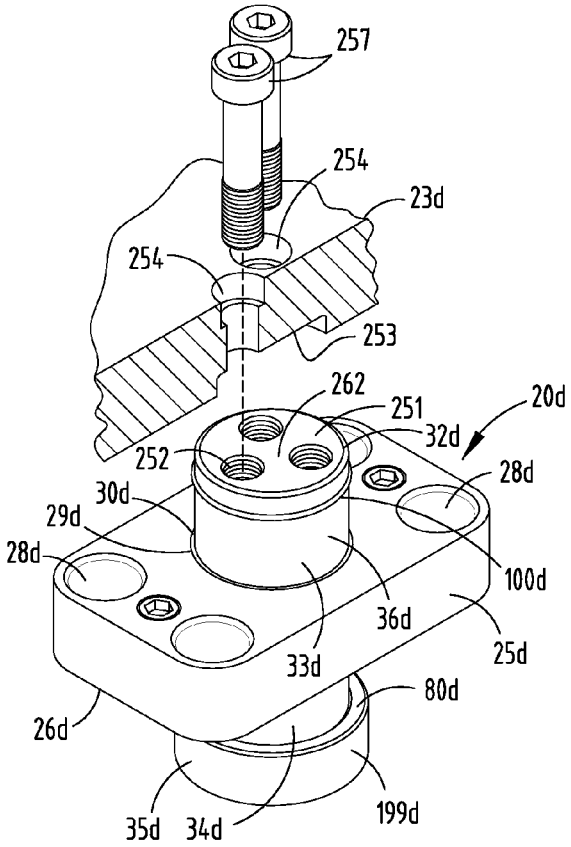
FIG. 43 is a perspective view of yet another embodiment of the present invention having a flat shouldered guide pin with offset fastener.
Figure 44:
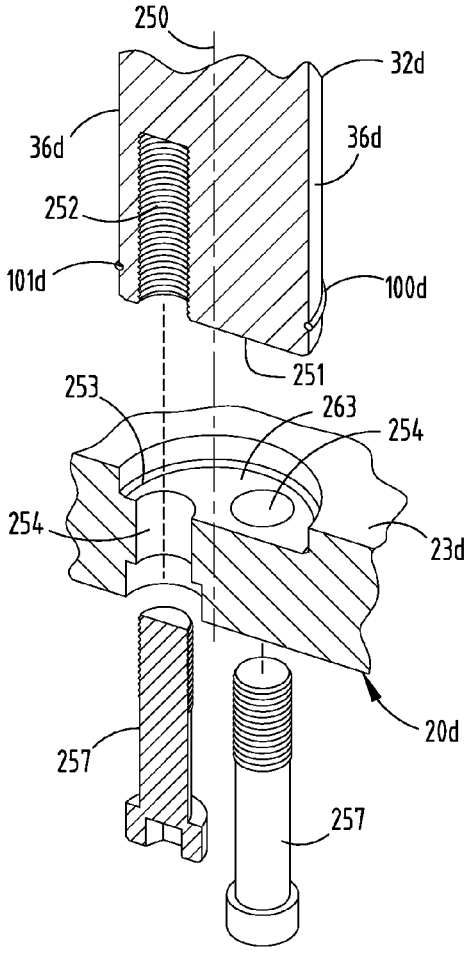
FIG. 44 is a fragmentary perspective view of the guided keeper shown in FIG. 43 with portions thereof broken away to reveal internal construction.
Figure 45:
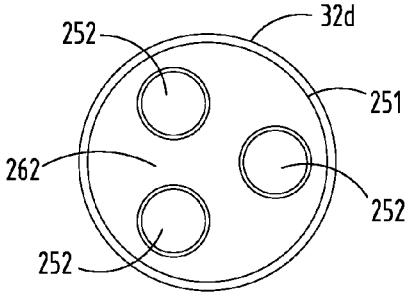
FIG. 45 is a plan view of a flat shouldered end portion of the guide pin shown in FIGS. 43-44.

A process embodying the present invention for making two-piece guide pin 190 is as follows. An elongate, solid bar of steel guide pin body stock 184 (FIG. 38) is selected having a cylindrical shape with a hard and smooth finished exterior surface having a predetermined outside diameter that is identical to that of the finished guide pin body 191. A chrome plated, solid steel rod has been found particularly beneficial, since it incorporates a very smooth, hard, mirror-like outer surface that is suitable for low friction, sliding reciprocal motion in an associated die bore or aperture. The bar of guide pin body stock 184 is cut into a plurality of blanks 196 having lengths commensurate with the height of the finished two-piece guide pin 190. More specifically, as described above, a cutoff tool is inserted radially into the bar stock 184 to a point where the remaining material severs, thereby forming cutoff nub 197 at the second end 193 of the guide pin body, as shown in FIGS. 35-36. In order to minimize processing time, cost and machining steps, cutoff nub 197 is simply left in place. The alignment member 198 is then machined into the first end 192 of guide pin body 191, and the external thread 212 is formed on the second end 193 of guide pin body 191. A solid bar of guide pin head stock is selected with a predetermined outside diameter that is substantially greater than the outside diameter of the bar of guide pin body stock 184, so as to create the enlarged head portion 183 of two-piece guide pin 180. The bar of guide pin head stock is then cut in longitudinal segments to define a plurality of disc-shaped guide pin head blanks 224 (FIG. 40). For each guide pin head 199, a circular recess 216 is formed in the interior face 216 thereof to define the cylindrically-shaped sidewall 217. The recess 210 is positioned, shaped and sized to receive therein the second end 193 of the guide pin body 181. An internal thread 218 is then formed in the sidewall 217 of the recess 210 of each guide pin head blanks 224, which has a relative coarse, deep thread and mates closely with the external thread 212 on the second end 193 of guide pin body 191. A pair of radially oriented apertures 220 are formed through the sidewall 217 of the guide pin head 199 and communicate with the recess 210 therein. A blind hole 221 is formed in the bottom wall 211 of guide pin head 199 with a shape and position to wholly receive therein cutoff nub 197, as shown in FIGS. 36 and 37. Identification indicia may be etched or otherwise applied to the flat exterior face 215 of guide pin head 183. The externally threaded second end 193 of the guide pin body 191 is then screwed into the internally threaded recess 210 in the guide pin head 199 to threadedly connect the guide pin head 183 with the guide pin body 181. Preferably, the guide pin head 183 and guide pin body 181 are simply hand tightened together, so as to minimize processing time and effort. In one embodiment of the present invention, one or more staking tools 225 (FIG. 37) are then driven through the radial apertures 220 in the guide pin head 183 and against adjacent portions of the external thread 212 on the second end 193 of the guide pin body 181 to upset the same, and thereby permanently interconnect the guide pin body 181 and the guide pin head 183 to define the enlarged head portion of the two-piece guide pin 180 that serves to positively limit travel between the die shoe and the die pad.

The reference numeral **20*d* (FIGS. 43-53) generally designate yet another embodiment of the present invention have a flat shoulder and offset retainer feature. Since the guided keeper assembly 20*d* is similar to the previously described guided keeper assembly 20, similar parts appearing in FIGS. 43-50 and FIGS. 1-21**, respectively, are represented by the same, corresponding reference numerals, except for the suffix "d" in the numerals of the latter.

The illustrated guided keeper assembly **20*d* (FIGS. 43-53) also includes a base 25*d* with a generally flat mounting face 26*d* shaped to abut an adjacent face of the die shoe, which is not shown in FIGS. 43-53, but is substantially identical to the die shoe 22 illustrated in FIGS. 1-18, and described in detail above, and at base 25*d* also has at least one fastener aperture 28*d* extending axially through a marginal portion of the base 25*d* for detachably mounting the base 25*d* to the die shoe, and a cylindrically shaped central aperture 29*d* extending axially through a central portion of the base 25*d* and having a bearing surface, which in the illustrated example, is formed by a bushing 30*d*. The guided keeper assembly 20*d* illustrated in FIGS. 43-53 also includes a guide pin 32*d* having a first end portion 34*d* with an enlarged head 35*d* shaped to abut the base 25*d* to positively limit travel between the die shoe and the die pad 23*d*, and a cylindrically shaped body portion 33*d* having a central axis 250, a uniform diameter extending along the entirety of the central axis 250 thereof selected for close reception in the central aperture 29*d* of the base 25*d*, and a second end portion 36*d* disposed opposite the first end portion 34*d*, and having a generally flat, terminal shoulder 251. The shoulder 251 has at least one fastener aperture 252 extending perpendicularly through the shoulder 251 of guide pin 32*d* and into the second end portion 36*d* thereof at a location spaced radially offset from the central axis 250 of the body portion 33*d* of the guide pin 32*d*, and oriented parallel therewith. A pocket or blind hole 253 is disposed in the die pad 23*d* at a preselected location, and closely receives therein the shoulder 251 of guide pin 32*d* for precisely guiding reciprocal motion between die pad 2*d* and die shoe 1. At least one fastener aperture 254 is disposed in the die pad 23*d* at a preselected location which opens into the blind hole 253. At least one fastener aperture, similar to fastener aperture 53 shown in FIGS. 1-18, and discussed above, is disposed in the die shoe at a preselected location. A first fastener, similar to fastener 40 shown in FIGS. 1-18, and discussed above, extends through the fastener aperture 28*d* in base 25*d* and engages the same in the fastener aperture of the die shoe 1 to securely, yet detachably, mount the base 25*d* to die shoe. A second fastener 257 extends through the fastener aperture 254 in die pad 2*d* and engages the same in the fastener aperture 252 in the second end portion 36*d* of guide pin 32*d* to securely, yet detachably, connect the second end portion 36*d* of guide pin 32*d* with the die pad 23*d* and positively prevent the guide pin 32*d* from rotating axially relative to the die pad 23*d***.

In the example illustrated in FIGS. 43-53, the second end portion **36*d* of guide pin 32*d* has a completely flat, circularly shaped terminal in face 262 which defines shoulder 251. Furthermore, the blind hole 253 has a completely flat bottom surface 263 which abuts flush with the inface 262 of shoulder 251 in the fully assembled condition, as best shown in FIGS. 46, 48 and 51-53**.

The guide pin 32*d* illustrated in FIGS. 43-53 may be formed from an elongate, solid bar of steel guide pin stock, with a cylindrical shape and a hard and smooth finished exterior surface having a predetermined outside diameter that is selected for close reception in the central aperture 29*d* of the base 25*d* for reciprocal motion with the bearing surface 30*d* of the base 25*d*, wherein the elongate bar is cut off to a predetermined length along a radially extending path that is precisely perpendicular to the central axis 250 thereof to a predetermined length that is at least as long as the body portion 33*d* of the guide pin 32*d* to define the shoulder 251 without further machining. Further, in the illustrated example, guide pin 32*d* includes three circumferentially spaced apart fastener apertures 252 that extend perpendicularly through the shoulder 251 of the guide pin 32*d* and into the second end 36*d* thereof at locations spaced radially offset from the central axis 250 of the body portion 33*d* of the guide pin 32*d*. The offset location of aperture 252 and associated fasteners 257 prevents the guide pin 32*d* from rotating axially during assembly, and the fastener from coming loose during operation. Furthermore, by using the guide pin body as the locator, the guide pin 32*d* has greater side load capacity and that provided by a stud or other type of central locator, such as that illustrated in FIGS. 1-2 and 22-23. Also, by using the guide pin body as the locator, greater accuracy between the die pad 23*d* and associated die set is achieved. The guide pin 32*d* also permits the use of larger diameter fasteners to provide greater holding power. Further, by utilizing the precision diameter, the guide pin body as the locator, the guide pin 32*d* is easier and quicker to machine than a guide pin using a round or other shaped stud, which must hold closer tolerances and extra quality checks. As discussed in greater detail below, when the guide pin 32*d* is initially assembled in the die pad 23*d*, one of the offset fasteners 257 can be used to hold the guide pin 32*d* in place while the operator installs the remaining fasteners 257.

Figure 46:
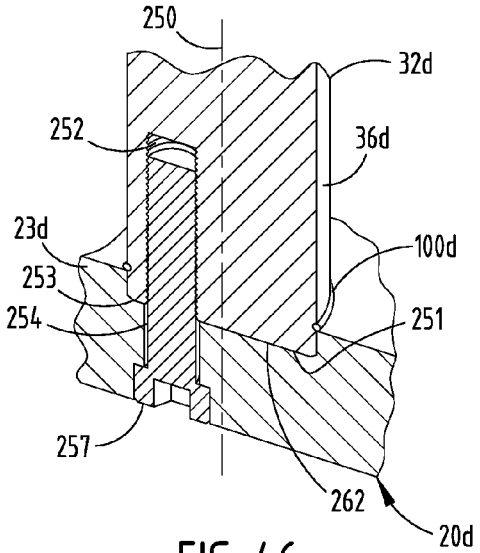
FIG. 46 is a fragmentary perspective view of the guided keeper shown in FIGS. 43-45, illustrated in a fully assembled condition, with portions thereof broken away to reveal internal construction.
Figure 47:
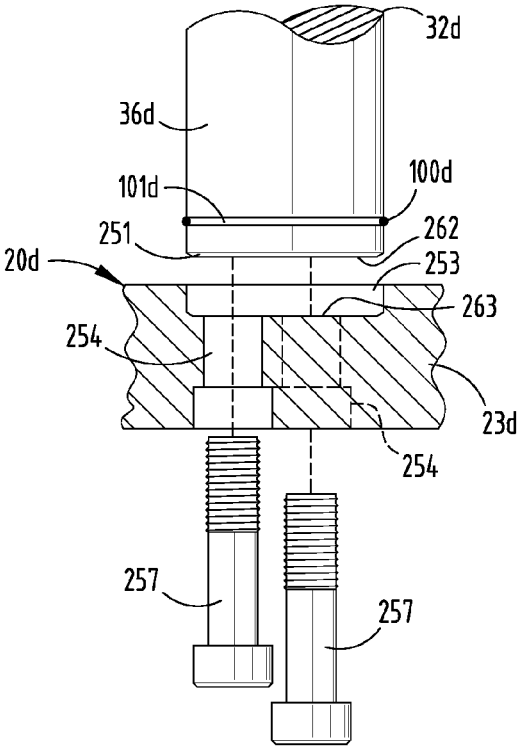
FIG. 47 is a fragmentary side elevational view of the guided keeper shown in FIGS. 43-46, illustrated in a disassembled condition.
Figure 48:
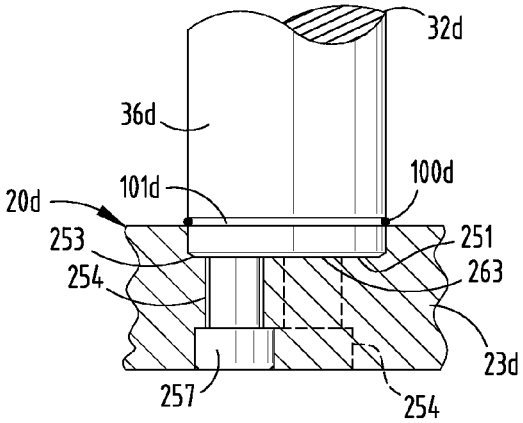
FIG. 48 is a fragmentary side elevational view of the guided keeper shown in FIGS. 43-47, illustrated in a fully assembled condition.
Figure 49:
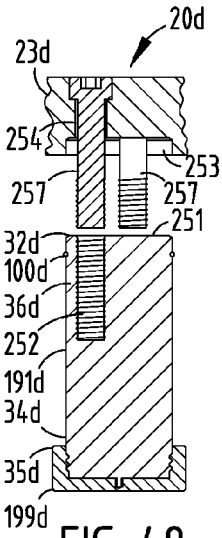
FIG. 49 is a cross-sectional view of the guided keeper shown in FIGS. 43-48, illustrated prior to assembly in an associated die shoe.

The illustrated guide pin 32*d* (FIGS. 43-53) includes a groove 101*d* in the second end 36*d* thereof at a location adjacent shoulder 251 in which a retaining ring 100*d* is received, similar to the embodiment illustrated in FIGS. 23-27 and discussed above. In the example illustrated in FIGS. 43-53, the distance between the groove 101*d* and shoulder 251 is selected to be substantially commensurate with the depth of the blind hold 253 in die pad 2*d*, such that retainer ring 100*d* abuts the upper surface of the die pad 2 in the fully assembled position, as best illustrated in FIGS. 46 and 48. The illustrated guide pin 32*d* also includes the two piece construction, illustrated in FIGS. 33-41, and described above, which as best shown in FIGS. 49-53, includes a screw-on guide pin head 199*d* which mounts on the cylindrical guide pin body 191*d*.

Figure 50:
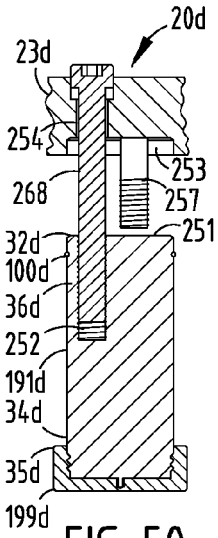
FIG. 50 is a cross-sectional view of the guided keeper shown in FIGS. 43-49, illustrated with an installation fastener in place prior to assembly.
Figure 51:
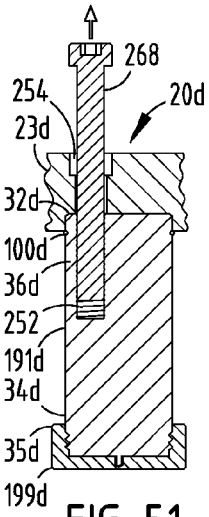
FIG. 51 is a cross-sectional view of the guided keeper shown in FIGS. 43-50, illustrated with the installation fastener shifted to place the guided keeper in a partially assembled condition.
Figure 52:
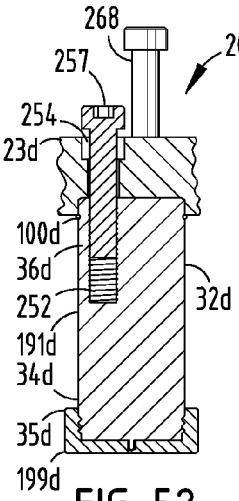
FIG. 52 is a cross-sectional view of the guided keeper shown in FIGS. 43-51, illustrated with the installation fastener removed and the guided keeper fastener partially installed.
Figure 53:
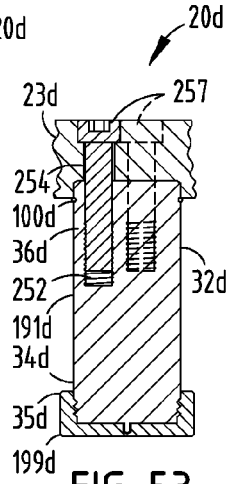
FIG. 53 is a cross-sectional view of the guided keeper shown in FIGS. 43-52, illustrated with the same in a fully assembled condition.
Figure 54:
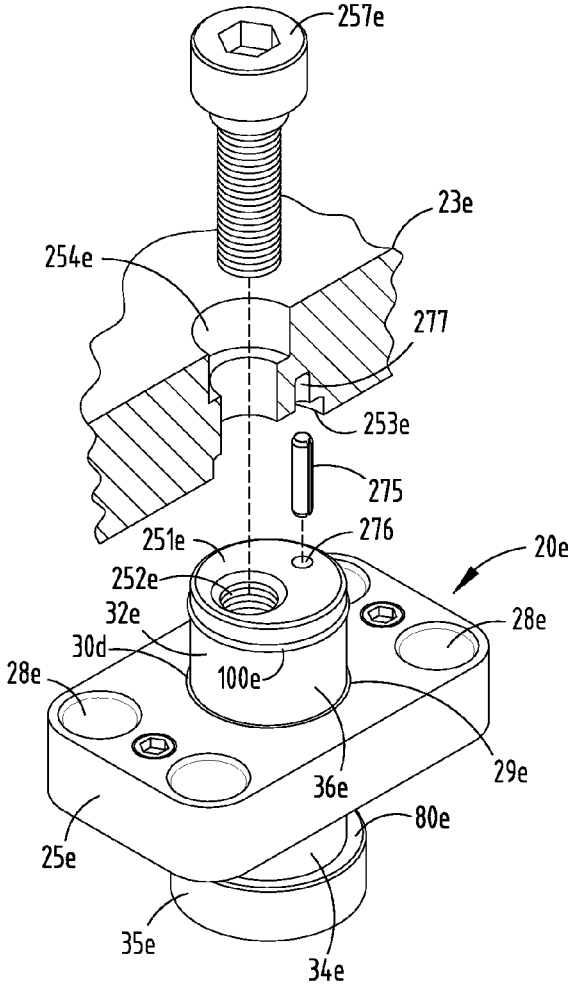
FIG. 54 is a perspective view of yet another embodiment of the present invention which incorporates a roll pin to facilitate mounting the guided keeper in an associated die pad.
Figure 55:
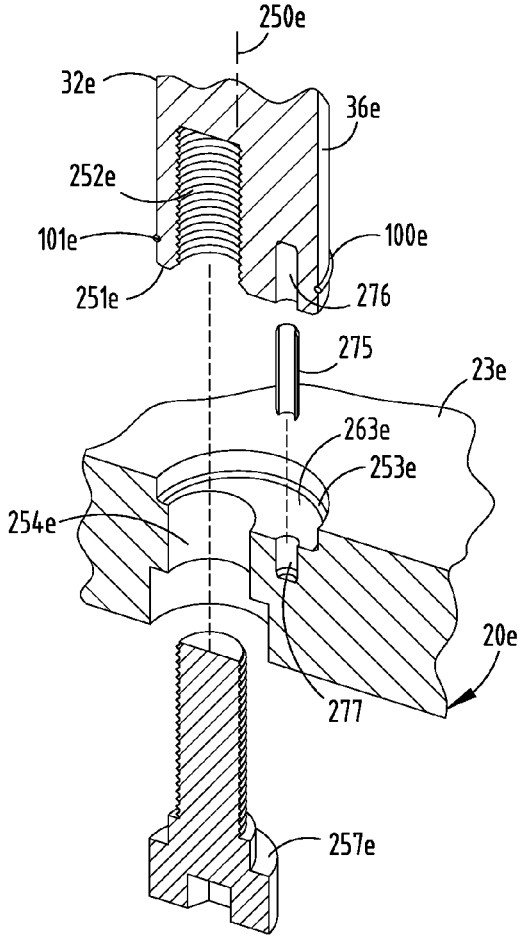
FIG. 55 is a fragmentary exploded view of the guided keeper shown in FIG. 54, with portions thereof broken away to reveal internal construction.
Figure 56:
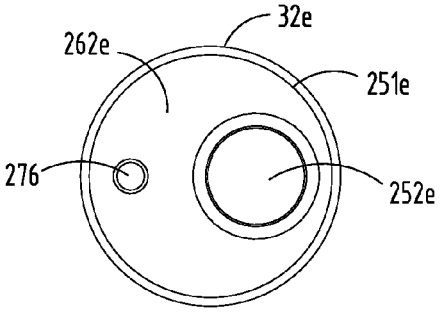
FIG. 56 is a plan view of a flat shouldered end portion of the guide pin shown in FIGS. 54-55.
Figure 57:
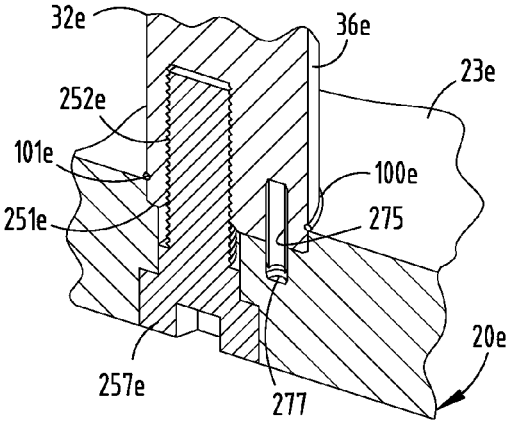
FIG. 57 is a fragmentary perspective view of the guided keeper shown in FIGS. 54-56, illustrated in a fully assembled condition.

Guided keeper assembly 20*d* can be mounted on an associated die pad 23*d* using an elongate installation fastener 268 in the manner illustrated in FIGS. 49-53. In the pre-assembled condition shown in FIG. 49, the die shoe and die pad 23*d* are separated, so that a gap exists between the shoulder 251 of guide pin 32*d* and the die pad 23*d*, which is substantially larger than the length of the retention fasteners 257. The elongate installation fastener 268 is inserted through one of the fastener apertures 254 in die pad 23*d*, and is threadedly engaged an aligned one of the fastener apertures 252 in the second end 36*d* of guide pin 32*d*, as shown in FIG. 50. Installation fastener 268 is then shifted axially, so as to draw the shoulder 251 of guide pin 32*d* into the blind hole 253 in die pad 23*d*, as shown in FIG. 51. Next, with the installation fastener 268 shifted in the position shown in FIG. 51, a retention fastener 257 is inserted through another one of the fastener apertures 254 in die pad 23*d* and engages into an aligned one of the fastener apertures 252 in the second end 36*d* of guide pin 32*d*, as shown in FIG. 52, and then tightened, so as to positively retain the guide pin 32*d* in blind hole 253. Next, the installation fastener 268 is disengaged from the guide pin 32*d*, and the remaining retention fasteners 257 are inserted into the remaining fastener apertures 254 in die pad 2 and engaged in the associated fastener apertures 252 in the second end portion 36*d* of the guide pin 32, and tightened to define the fully assembled condition shown in FIG. 48.

The reference numeral 20*e* (FIGS. 54-64) generally designates yet another embodiment of the present invention, having a roll pin feature. Since guided keeper assembly 20*e* is similar to the previously described guided keeper assembly 20, as well as guided keeper assembly 20*e*, similar parts appearing in FIGS. 54-64 and FIGS. 1-21 and 43-53, respectively, represented by the same, corresponding reference numerals, except for the suffix "e" in the numerals of the latter.

The illustrated guided keeper assembly 20*e* (FIGS. 54-64) includes a roll pin 275 which is received into oppositely disposed roll pin apertures 276 and 277 in the shoulder 251*e* of guide pin 32*e* and the die pad 23*e*, serves to temporarily retain the shoulder 251*e* of guide pin 32*e* in the blind hold 253*e* of die pad 23*e* during assembly. Roll pin 275 can be used either as an alternative to or an addition to the installation fastener 268 technique (FIGS. 49-53) described above relative to guided keeper assembly 20*d*. More specifically, the guided keeper assembly 20*e* has a construction very similar to that of previously described guided keeper assembly 20*d*, except that in the illustrated example, guided keeper assembly 2*e* has a single fastener aperture 254*e* in the die pad 23*e* which opens into the blind hole 253*e*. The location of fastener aperture 252*e* is axially offset relative to the central axis of guide pin 32*e* so as to prevent rotation of guide pin 32*e* relative to die pad 23*e*. Roll pin apertures 276 and 277 are similar offset axially relative to the central axis of guide pin 32*e*, and similarly prevent rotation between guide pin 32*e* and die pad 2*e*. The illustrated roll pin 275 has a conventional construction, such as a split tube like cylinder made from spring steel or the like, and is shaped for close frictional reception in roll pin aperture 276 and 277.

As best illustrated in FIGS. 58-64, during installation of guided keeper assembly 20*e* on die pad 23*e*, one end of the roll pin 275 is first inserted into the roll pin aperture 276 in the second end portion 36*e* of die pin 32*e*, as shown in FIGS. 60 and 61. Next, the installation fastener 268*e* is inserted through the fastener aperture 254*e* in die pad 23*e* and engaged into the fastener aperture 252*e* in the second end portion 36*e* of guide pin 32*e*. The installation fastener 268 is then shifted in the manner illustrated in FIGS. 61 and 62, so as to draw the shoulder 251*e* of guide pin 32*e* into the blind hole 235*e* in die pad 23*e*, and contemporaneously insert the opposite end of roll pin 275 into the roll pin aperture 277 in die pad 23*e*. The roll pin 275 temporarily retains the shoulder 251*e* of guide pin 32*e* in the blind hole 253*e* of die pad 2*e*, thereby permitting removal of installation fastener 268*e*, as illustrated in FIGS. 62 and 63. Next, retention fastener 257*e* is inserted through the fastener aperture 254*e* in die pad 23*e* and engaged into the fastener aperture 252*e* in the second end portion 36*e* of guide pin 32*e* to positively connect the guide pin 32*e* with die pad 23*e*, as shown in FIGS. 59 and 64.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is as follows:

1. A method for making a metal forming die of the type having a die shoe, a die pad mounted a spaced apart distance from the die shoe for reciprocation between converged and diverged positions, and a biasing member disposed between the die shoe and the die pad for biasing the same to the diverged position, comprising:

forming a base with a mounting face shaped to abut an adjacent face of the die shoe, at least one fastener aperture extending axially through a marginal portion of the base for detachably mounting the base to the die shoe, and a cylindrically-shaped central aperture extending axially through a central portion of the base and having a bearing surface;

forming a guide pin with a first end portion having an enlarged head shaped to abut the base to positively limit travel between the die shoe and the die pad, and a cylindrically-shaped body portion having a uniform diameter extending along the entirety of the central axis thereof selected for close reception in the central aperture of the base and a second end portion disposed opposite the first end portion with a generally flat, terminal shoulder with an outer diameter;

forming a single fastener aperture perpendicularly through the terminal shoulder of the guide pin and into the second end portion thereof at a location spaced radially offset from the central axis of the body portion of the guide pin, and oriented parallel therewith;

forming a blind hole in the die pad at a preselected location with a diameter shaped for close reception of the outer diameter of the terminal shoulder of the guide pin therein;

forming a single fastener aperture in the die pad at a preselected location which opens into the blind hole;

forming at least one fastener aperture in the die shoe at a preselected location;

inserting the body portion of the guide pin into the central aperture of the base for precisely guiding reciprocal motion between the die pad and the die shoe;

inserting a first fastener through the fastener aperture in the base and engaging the same in the fastener aperture of the die shoe to securely, yet detachably, mount the base to the die shoe;

inserting the terminal shoulder on the second end portion of the guide pin into the blind hole in the die pad to precisely locate the second end portion of the guide pin in the die pad; and inserting a second fastener through the fastener aperture in the die pad and engaging the same in the fastener aperture in the second end portion of the guide pin to securely, yet detachably connect the second end portion of the guide pin with the die pad and positively prevent the guide pin from rotating axially relative to the die pad.

2. A method as set forth in claim 1, wherein:

said guide pin forming step includes forming the second end portion of the guide pin with a completely flat, circularly-shaped terminal end face that is disposed perpendicular with the central axis of the guide pin to define the shoulder.

3. A method as set forth in claim 2, wherein:

said blind hole forming step includes forming a completely flat bottom surface of said blind hole which is adapted to abut flush with the terminal shoulder of the guide pin; and said terminal shoulder inserting step includes inserting the second end portion of the guide pin into the blind hole until the terminal shoulder of the guide pin abuts flush with the bottom of the blind hole.

4. A method as set forth in claim 3, wherein:

said blind hole forming step includes reaming the blind hole in the die pad to a precise shape and size.

5. A method as set forth in claim 4, wherein:

said guide pin forming step further includes:

selecting an elongate, solid bar of steel guide pin body stock with a cylindrical shape and a finished exterior surface having a predetermined outside diameter selected for close reception in the central aperture of the base for reciprocal motion with the bearing surface of the base;

cutting off the elongate bar to a predetermined length along a radially extending path that is precisely perpendicular to the central axis thereof to a predetermined length that is at least as long as the body portion of the guide pin to define the terminal shoulder without further machining.

6. A method as set forth in claim 5, wherein;

said guide pin fastener aperture forming step includes forming at least first and second, circumferentially spaced apart fastener apertures perpendicularly through the terminal shoulder of the guide pin and into the second end thereof at locations spaced radially offset from the central axis of the body portion of the guide pin, and oriented parallel therewith; and said die pad fastener aperture forming step includes forming at least first and second fastener apertures in the die pad at preselected locations which align during assembly with the first and second fastener apertures in the second end portion of the guide pin.

7. A method as set forth in claim 6, wherein:

said terminal shoulder inserting step includes before said second fastener inserting step:

inserting an elongate installation fastener having an enlarged head at one end and a thread at the opposite end through the second fastener apertures in the die pad;

threaded engaging the thread on the installation fastener with the second fastener aperture in the second end portion of the guide pin; and shifting the head of the installation fastener upwardly thereby shifting the terminal shoulder of the guide pin into the blind hole in the die pad.

8. A method as set forth in claim 7, wherein;

said terminal shoulder inserting step further includes after said installation fastener shifting step:

inserting the second fastener through the first fastener aperture in the die pad and engaging the same in the first fastener aperture in the second end portion of the guide pin to securely, yet detachably, connect the second end portion of the guide pin with the die pad and positively prevent the guide pin from rotating axially relative to the die pad;

unscrewing the installation fastener from the second fastener aperture in the second end portion of the guide pin, and removing the installation fastener from the second fastener aperture in the die pad; and inserting a third fastener through the second fastener aperture in the die pad and engaging the same in the second fastener aperture in the second end portion of the guide pin to securely, yet detachably, connect the second end portion of the guide pin with the die pad, and positively prevent the guide pin from rotating axially relative to the die pad.

9. A method as set forth in claim 7, including:

forming a first roll pin aperture perpendicularly through the terminal shoulder of the guide pin and into the second end thereof at a location spaced radially offset from the central axis of the body portion of the guide pin, oriented parallel therewith, and circumferentially spaced from the first and second fastener apertures in the guide pin;

forming a second roll pin aperture perpendicularly through the bottom surface of the blind hole in the die pad at a location aligned when assembled with the first roll pin aperture in the guide pin;

inserting one end of a roll pin into the first roll pin aperture in the guide pin before said installation fastener shifting step, such that when the terminal shoulder of the guide pin is inserted into the blind hole in the die pad, the other end of the roll pin is inserted into the second roll pin aperture in the die pad and thereby retains the same together prior to said second fastener inserting step.

10. A method as set forth in claim 9, wherein;

said guide pin forming step includes:

selecting an elongate, solid bar of guide pin head stock having a predetermined outside diameter that is substantially greater than the outside diameter of the bar of guide pin body stock;

cutting a preselected length of the bar of guide pin head stock to define a guide pin head; and rigidly connecting the guide pin head with the second end of the guide pin body in a generally concentric relationship to define the enlarged head that serves to positively limit travel between the die shoe and the die pad.

11. A method as set forth in claim 10, wherein:

said guide pin forming step includes:

forming an external thread on the guide pin at a location adjacent to the first end portion thereof;

forming a recess with a cylindrically-shaped sidewall in an interior face of the guide pin head sized to receive therein the second end of the guide pin body;

forming an internal thread in the sidewall of the recess in the guide pin head which mates with the external thread on the second end of the guide pin body;

screwing the externally threaded second end of the guide pin body into the internally threaded recess in the guide pin head to threadedly connect the guide pin head with the guide pin body.

12. A method as set forth in claim 11, wherein:

said guide pin forming step includes:

forming at least one radially oriented aperture through the sidewall of the guide pin head which communicates with the recess therein;

driving a tool through the radial aperture in the guide pin head and against an adjacent portion of the external thread on the second end of the guide pin body to upset the same and thereby permanently interconnect the guide pin body and the guide pin head.

13. A method as set forth in claim 12, including:

inserting a bushing in the central aperture of the base to define the bearing surface.

14. A method as set forth in claim 13, including:

positioning a resilient washer on the guide pin between the enlarged head and the base to absorb impact therebetween.

15. A method as set forth in claim 14, wherein:

said guide pin forming step includes:

power polishing the exterior surface of the bar of guide pin body stock prior to said guide pin body bar stock cutting step.

16. A method as set forth in claim 15, wherein:

said screwing step comprises hand tightening.

17. A method as set forth in claim 16, wherein:

said plating step comprises chrome plating.

18. A method as set forth in claim 17, wherein:

said thread forming steps comprise cutting deep and course mating threads in the guide pin body and the guide pin cap.

19. A method as set forth in claim 18, including:

forming a pair of flats on opposite sides of the guide pin body adjacent the second end portion thereof.

20. A method as set forth in claim 1, wherein:

said guide pin forming step further includes:

selecting an elongate, solid bar of steel guide pin body stock with a cylindrical shape and a finished exterior surface having a predetermined outside diameter selected for close reception in the central aperture of the base for reciprocal motion with the bearing surface of the base;

cutting off the elongate bar to a predetermined length along a radially extending path that is precisely perpendicular to the central axis thereof to a predetermined length that is at least as long as the body portion of the guide pin to define the terminal shoulder without further machining.

21. A method as set forth in claim 20, wherein;

said guide pin forming step includes:

selecting an elongate, solid bar of guide pin head stock having a predetermined outside diameter that is substantially greater than the outside diameter of the bar of guide pin body stock;

cutting a preselected length of the bar of guide pin head stock to define a guide pin head; and rigidly connecting the guide pin head with the second end of the guide pin body in a generally concentric relationship to define the enlarged head that serves to positively limit travel between the die shoe and the die pad.

22. A method as set forth in claim 1, wherein;

said guide pin fastener aperture forming step includes forming at least first and second, circumferentially spaced apart fastener apertures perpendicularly through the terminal shoulder of the guide pin and into the second end thereof at locations spaced radially offset from the central axis of the body portion of the guide pin, and oriented parallel therewith; and said die pad fastener aperture forming step includes forming at least first and second fastener apertures in the die pad at preselected locations which align during assembly with the first and second fastener apertures in the second end portion of the guide pin.

23. A method as set forth in claim 22, wherein:

said terminal shoulder inserting step includes before said second fastener inserting step:

inserting an elongate installation fastener having an enlarged head at one end and a thread at the opposite end through the second fastener apertures in the die pad;

threaded engaging the thread on the installation fastener with the second fastener aperture in the second end portion of the guide pin;

shifting the head of the installation fastener upwardly thereby shifting the terminal shoulder of the guide pin into the blind hole in the die pad.

24. A method as set forth in claim 23, wherein;

said terminal shoulder inserting step further includes after said installation fastener shifting step:

inserting the second fastener through the first fastener aperture in the die pad and engaging the same in the first fastener aperture in the second end portion of the guide pin to securely, yet detachably, connect the second end portion of the guide pin with the die pad and positively prevent the guide pin from rotating axially relative to the die pad;

unscrewing the installation fastener from the second fastener aperture in the second end portion of the guide pin, and removing the installation fastener from the second fastener aperture in the die pad;

inserting a third fastener through the second fastener aperture in the die pad and engaging the same in the second fastener aperture in the second end portion of the guide pin to securely, yet detachably, connect the second end portion of the guide pin with the die pad, and positively prevent the guide pin from rotating axially relative to the die pad.

25. A method as set forth in claim 1, including:

forming a first roll pin aperture perpendicularly through the terminal shoulder of the guide pin and into the second end thereof at a location spaced radially offset from the central axis of the body portion of the guide pin, oriented parallel therewith, and circumferentially spaced from the first and second fastener apertures in the guide pin;

forming a second roll pin aperture perpendicularly through the bottom surface of the blind hole in the die pad at a location aligned when assembled with the first roll pin aperture in the guide pin;

inserting one end of a roll pin into the first roll pin aperture in the guide pin before said installation fastener shifting step, such that when the terminal shoulder of the guide pin is inserted into the blind hole in the die pad, the other end of the roll pin is inserted into the second roll pin aperture in the die pad and thereby retains the same together prior to said second fastener inserting step.

26. In a metal forming die having a die shoe, a die pad mounted a spaced apart distance from said die shoe for reciprocation between converged and diverged positions, and a biasing member disposed between said die shoe and said die pad for biasing the same to said diverged position, the improvement of a guided keeper, comprising:

a base with a mounting face shaped to abut an adjacent face of said die shoe, at least one fastener aperture extending axially through a marginal portion of said base for detachably mounting said base to said die shoe, and a cylindrically-shaped central aperture extending axially through a central portion of said base and having a bearing surface;

a guide pin having a first end portion with an enlarged head shaped to abut said base to positively limit travel between said die shoe and said die pad, and a cylindrically-shaped body portion having a central axis, a uniform diameter extending along the entirety of said central axis thereof selected for close reception in said central aperture of said base and a second end portion disposed opposite said first end portion with a generally flat, terminal shoulder with an outer diameter; said terminal shoulder having a single fastener aperture extending perpendicularly through said terminal shoulder of said guide pin and into said second end portion thereof at a location spaced radially offset from said central axis of said body portion of said guide pin, and oriented parallel therewith;

a blind hole disposed in said die pad at a preselected location and closely receiving therein the outer diameter of said terminal shoulder of said guide pin for precisely locating the second end portion of the guide pin in the die pad;

at least one fastener aperture disposed in said die pad at a preselected location which opens into said blind hole;

at least one fastener aperture disposed in said die shoe at a preselected location;

a first fastener extending through said fastener aperture in said base and engaging the same in said fastener aperture of said die shoe to securely, yet detachably, mount said base to said die shoe; and a second fastener extending through said fastener aperture in said die pad and engaging the same in said fastener aperture in said second end portion of said guide pin to securely, yet detachably connect said second end portion of said guide pin with said die pad and positively prevent said guide pin from rotating axially relative to said die pad.

27. A metal forming die as set forth in claim 26, wherein:

said second end portion of said guide pin has a completely flat, circularly-shaped terminal end face that is disposed perpendicular with said central axis of said guide pin to define said terminal shoulder.

28. A metal forming die as set forth in claim 27, wherein:

said blind hole has a completely flat bottom surface which abuts flush with said terminal shoulder of the guide pin in a fully assembled condition.

29. A metal forming die as set forth in claim 28, wherein:

said guide pin is formed from an elongate, solid bar of steel guide pin body stock with a cylindrical shape and a finished exterior surface having a predetermined outside diameter selected for close reception in said central aperture of said base for reciprocal motion with said bearing surface of said base, and said elongate bar is cut off to a predetermined length along a radially extending path that is precisely perpendicular to the central axis thereof to a predetermined length that is at least as long as said body portion of said guide pin to define said terminal shoulder without further machining.

30. A metal forming die as set forth in claim 29, wherein;

said guide pin includes first and second, circumferentially spaced apart fastener apertures extending perpendicularly through said terminal shoulder of said guide pin and into said second end thereof at locations spaced radially offset from said central axis of said body portion of said guide pin, and oriented parallel therewith; and said die pad includes first and second fastener apertures in said die pad at preselected locations which align during assembly with said first and second fastener apertures in said second end portion of said guide pin.

31. A guided keeper for a metal forming die of the type having a die shoe, a die pad mounted a spaced apart distance from the die shoe for reciprocation between converged and diverged positions, and a biasing member disposed between the die shoe and the die pad for biasing the same to the diverged position, comprising:

a base having a mounting face shaped to abut an adjacent face of the die shoe, at least one fastener aperture extending axially through a marginal portion of the base for detachably mounting the base to the die shoe, and a cylindrically-shaped central aperture extending axially through a central portion of said base and having a bearing surface;

a guide pin having a first end portion thereof with an enlarged head shaped to abut said base to positively limit travel between the die shoe and the die pad, and a cylindrically-shaped body portion having a central axis, a uniform diameter extending along the entirety of said central axis thereof for close reception in said central aperture of said base and a second end portion disposed opposite said first end portion with a generally flat, terminal shoulder with an outer diameter configured for close reception in a blind hole in the die pad to precisely locate the second end portion of the guide pin in the die pad; said terminal shoulder having a single fastener aperture extending perpendicularly therethrough and into said second end portion thereof at a location spaced radially offset from said central axis of said body portion of said guide pin, and oriented parallel therewith;

a first fastener extending through said fastener aperture in said base and engaging the same in an associated fastener aperture in the die shoe to securely, yet detachably, mount said base to the die shoe; and a second fastener extending through an associated fastener aperture in the die pad and engaging the same in said fastener aperture in said second end portion of said guide pin to securely, yet detachably, connect said second end portion of said guide pin with the die pad and positively prevent said guide pin from rotating axially relative to the die pad.

32. A guided keeper as set forth in claim 31, wherein:

said second end portion of said guide pin has a completely flat, circularly-shaped terminal end face that is disposed perpendicular with said central axis of said guide pin to define said terminal shoulder.

33. A guided keeper as set forth in claim 32, wherein:

said guide pin is formed from an elongate, solid bar of steel guide pin body stock with a cylindrical shape and a finished exterior surface having a predetermined outside diameter selected for close reception in said central aperture of said base for reciprocal motion with the bearing surface of said base; and said elongate bar is cut off to a predetermined length along a radially extending path that is precisely perpendicular to the central axis thereof to a predetermined length that is at least as long as said body portion of said guide pin to define said terminal shoulder without further machining.

34. A guided keeper as set forth in claim 33, wherein;

said guide pin includes first and second, circumferentially spaced apart fastener apertures extending perpendicularly through said terminal shoulder of said guide pin and into said second end thereof at locations spaced radially offset from said central axis of said body portion of said guide pin, and oriented parallel therewith.

* * * * *